US008491145B2

(12) United States Patent
Waters

(10) Patent No.: US 8,491,145 B2
(45) Date of Patent: Jul. 23, 2013

(54) ILLUMINATED HEADGEAR HAVING SWITCH DEVICES AND PACKAGING THEREFOR

(75) Inventor: Michael Waters, Aspen, CO (US)

(73) Assignee: Waters Industries, Inc., West Dundee, IL (US)

( * ) Notice: Subject to any disclaimer, the term of this patent is extended or adjusted under 35 U.S.C. 154(b) by 353 days.

(21) Appl. No.: 12/957,133

(22) Filed: Nov. 30, 2010

(65) Prior Publication Data

US 2011/0122601 A1 May 26, 2011

Related U.S. Application Data

(60) Continuation-in-part of application No. 12/829,786, filed on Jul. 2, 2010, now Pat. No. 8,333,485, which is a division of application No. 12/363,130, filed on Jan. 30, 2009, now Pat. No. 7,753,547, which is a continuation of application No. PCT/US2008/087542, filed on Dec. 18, 2008.

(60) Provisional application No. 61/014,726, filed on Dec. 18, 2007, provisional application No. 61/330,185, filed on Apr. 30, 2010.

(51) Int. Cl.
*F21V 21/084* (2006.01)

(52) U.S. Cl.
USPC ..... 362/106; 2/209.13; 2/906; 200/304; 206/8; 362/105; 362/234; 362/376

(58) Field of Classification Search
USPC ... 2/175.1, 191, 209.13, 906; 200/304; 206/8; 362/103, 105, 376, 234, 253
See application file for complete search history.

(56) References Cited

U.S. PATENT DOCUMENTS 645,984 A 3/1900 Tournier
909,742 A 1/1909 Borchert (Continued)

FOREIGN PATENT DOCUMENTS

AU 11785/76 9/1977
AU 63109/94 11/1994

(Continued)

OTHER PUBLICATIONS

Notification of Transmittal of the International Search Report and the Written Opinion of the International Searching Authority, or the Declaration from the International Bureau of WIPO for related International Application No. PCT/US2011/034695 dated Oct. 28, 2011, 12 pages.

(Continued)

*Primary Examiner* — Stephen F Husar
(74) *Attorney, Agent, or Firm* — Fitch, Even, Tabin & Flannery, LLP

(57) ABSTRACT

There is provided hands-free lighting, components thereof, and other accessories for being combined with the hands-free lighting. The hands-free lighting is preferably lighted headgear including hats and includes various accessories for use therewith, such as lighted headgear having two switch or actuator devices mounted thereto. The two switch devices can include a temporary switch device and a maintained switch device. The lighted headgear can further include a switch guard associated therewith. The lighted headgear can alternatively or also include a switch cover. The switch guard and/or the switch cover can be associated with packaging configured to mount to the lighted hat to substantially prevent inadvertent activation while still allowing intentional actuation thereof, or substantially prevent activation thereof, respectively.

42 Claims, 12 Drawing Sheets

U.S. PATENT DOCUMENTS

| | | | |
|---|---|---|---|
| 1,098,628 | A | 6/1914 | Hyman |
| 1,109,415 | A | 9/1914 | Harris |
| 1,255,265 | A | 2/1918 | Zachara |
| 1,323,822 | A | 12/1919 | Bramming |
| 1,572,210 | A | 2/1926 | Kolibas |
| 1,744,777 | A | 1/1930 | Lundgren |
| 1,749,998 | A | 3/1930 | Collins |
| D137,375 | S | 2/1944 | Heit |
| 2,369,829 | A | 2/1945 | Johnson |
| 2,373,553 | A | 4/1945 | Fetterman |
| 2,461,254 | A | 2/1949 | Bassett |
| 2,473,394 | A | 6/1949 | Scott |
| 2,540,435 | A | 2/1951 | Ferguson |
| 2,552,764 | A | 5/1951 | Bedford, Jr. |
| 2,638,532 | A | 5/1953 | Brady |
| 2,640,980 | A | 6/1953 | Prupis |
| 2,705,751 | A | 4/1955 | Harris et al. |
| 2,788,439 | A | 4/1957 | Hesse |
| 2,904,670 | A | 9/1959 | Calmes |
| 2,978,696 | A | 4/1961 | Keller et al. |
| 3,008,040 | A | 11/1961 | Moore |
| 3,032,647 | A | 5/1962 | Wansky et al. |
| 3,040,881 | A | 6/1962 | McNeil |
| 3,057,992 | A | 10/1962 | Baker |
| 3,060,308 | A | 10/1962 | Fortuna |
| 3,123,208 | A | 3/1964 | Barnum et al. |
| 3,184,058 | A | 5/1965 | Crowther |
| 3,201,771 | A | 8/1965 | Proulx |
| 3,350,552 | A | 10/1967 | Lawrence |
| 3,358,137 | A | 12/1967 | Sinclair et al. |
| 3,491,374 | A | 1/1970 | Frangos |
| 3,537,909 | A | 11/1970 | Horton |
| 3,602,759 | A | 8/1971 | Evans et al. |
| 3,666,901 | A | 5/1972 | Weinhart |
| 3,749,902 | A | 7/1973 | Drew |
| 3,845,389 | A | 10/1974 | Phillips et al. |
| 3,947,676 | A | 3/1976 | Battilana et al. |
| 3,963,917 | A | 6/1976 | Romano |
| 4,005,776 | A | 2/1977 | Seeley |
| 4,011,600 | A | 3/1977 | Malk |
| 4,053,688 | A | 10/1977 | Perkins et al. |
| 4,186,429 | A | 1/1980 | Johnston |
| 4,210,952 | A | 7/1980 | Ressmeyer |
| 4,231,079 | A | 10/1980 | Heminover |
| 4,268,894 | A | 5/1981 | Bartunek et al. |
| 4,283,127 | A | 8/1981 | Rosenwinkel et al. |
| 4,298,913 | A | 11/1981 | Lozar |
| 4,364,107 | A | 12/1982 | Wieczorek et al. |
| 4,398,237 | A | 8/1983 | Doyel |
| 4,406,040 | A | 9/1983 | Cannone |
| D272,733 | S | 2/1984 | Cosmos et al. |
| 4,442,478 | A | 4/1984 | Stansbury |
| 4,462,064 | A | 7/1984 | Schweitzer |
| 4,470,263 | A | 9/1984 | Lehovec et al. |
| 4,483,021 | A | 11/1984 | McCall |
| 4,516,157 | A | 5/1985 | Campbell |
| 4,521,831 | A | 6/1985 | Thayer |
| 4,541,698 | A | 9/1985 | Lerner |
| 4,551,857 | A | 11/1985 | Galvin |
| 4,559,516 | A | 12/1985 | Schott et al. |
| 4,570,206 | A | 2/1986 | Deutsch |
| 4,602,191 | A | 7/1986 | Davila |
| 4,604,760 | A | 8/1986 | Coin |
| 4,638,410 | A | 1/1987 | Barker |
| 4,642,817 | A | 2/1987 | Ferstenfeld |
| 4,665,568 | A | 5/1987 | Stutes |
| 4,669,610 | A | 6/1987 | Lindsey et al. |
| 4,680,815 | A | 7/1987 | Hirsch et al. |
| 4,794,496 | A | 12/1988 | Lanes et al. |
| 4,817,212 | A | 4/1989 | Benoit |
| 4,827,384 | A | 5/1989 | Von Schlemmer |
| 4,872,218 | A | 10/1989 | Holt |
| 4,901,210 | A | 2/1990 | Hanabusa |
| 4,901,211 | A | 2/1990 | Shen |
| 4,945,458 | A | 7/1990 | Batts et al. |
| 4,951,068 | A | 8/1990 | Ichikawa et al. |
| 4,959,760 | A | 9/1990 | Wu |
| 4,963,045 | A | 10/1990 | Willcox |
| 4,991,068 | A | 2/1991 | Mickey |
| 4,998,187 | A | 3/1991 | Herrick |
| D316,932 | S | 5/1991 | Escher, Jr. |
| 5,039,829 | A | 8/1991 | Brucksch |
| 5,060,814 | A | 10/1991 | Oglesbee |
| 5,068,771 | A | 11/1991 | Savage, Jr. |
| 5,070,436 | A | 12/1991 | Alexander et al. |
| 5,088,127 | A | 2/1992 | Thornock |
| 5,111,366 | A | 5/1992 | Rife et al. |
| 5,113,325 | A | 5/1992 | Eisenbraun |
| 5,122,943 | A | 6/1992 | Pugh |
| 5,140,116 | A | 8/1992 | Schmitt-Walter |
| 5,140,220 | A | 8/1992 | Hasegawa |
| 5,143,443 | A | 9/1992 | Madsen |
| 5,163,420 | A | 11/1992 | Van Dear Bel |
| 5,165,789 | A | 11/1992 | Womack |
| 5,189,512 | A | 2/1993 | Cameron et al. |
| 5,193,220 | A | 3/1993 | Ichinohe et al. |
| 5,193,347 | A | 3/1993 | Apisdorm |
| 5,218,385 | A | 6/1993 | Lii |
| 5,224,772 | A | 7/1993 | Fustos |
| 5,230,558 | A | 7/1993 | Jong |
| 5,238,344 | A | 8/1993 | Nagayama |
| 5,245,516 | A | 9/1993 | de Haas et al. |
| 5,249,675 | A | 10/1993 | Strauss et al. |
| 5,278,734 | A | 1/1994 | Ferber |
| D349,123 | S | 7/1994 | Cooley et al. |
| 5,329,637 | A | 7/1994 | Walker |
| 5,331,333 | A | 7/1994 | Tagawa et al. |
| 5,331,357 | A | 7/1994 | Cooley et al. |
| 5,357,409 | A | 10/1994 | Glatt |
| 5,363,291 | A | 11/1994 | Steiner |
| 5,404,593 | A | 4/1995 | Kronenberger |
| 5,408,393 | A | 4/1995 | Becker |
| 5,410,746 | A | 4/1995 | Gelber |
| 5,412,545 | A | 5/1995 | Rising |
| 5,418,565 | A | 5/1995 | Smith |
| 5,423,419 | A | 6/1995 | Wentz et al. |
| 5,438,698 | A | 8/1995 | Burton et al. |
| 5,452,190 | A | 9/1995 | Priesemuth |
| 5,460,346 | A | 10/1995 | Hirsch |
| 5,463,538 | A | 10/1995 | Womack |
| 5,467,992 | A | 11/1995 | Harkness |
| 5,485,358 | A | 1/1996 | Chien |
| 5,503,637 | A | 4/1996 | Kyricos et al. |
| 5,508,900 | A | 4/1996 | Norman |
| 5,510,961 | A | 4/1996 | Peng |
| 5,541,767 | A | 7/1996 | Murphy et al. |
| 5,541,816 | A | 7/1996 | Miserendino |
| 5,542,627 | A | 8/1996 | Crenshaw et al. |
| 5,546,099 | A | 8/1996 | Quint et al. |
| 5,564,128 | A | 10/1996 | Richardson |
| 5,567,038 | A | 10/1996 | Lary |
| 5,575,554 | A | 11/1996 | Guritz |
| 5,610,678 | A | 3/1997 | Tsuboi et al. |
| 5,644,189 | A | 7/1997 | Busby |
| 5,655,374 | A | 8/1997 | Santilli |
| 5,667,291 | A | 9/1997 | Caplan et al. |
| 5,667,292 | A | 9/1997 | Sabalvaro, Jr. |
| 5,676,449 | A | 10/1997 | Newsome |
| 5,677,079 | A | 10/1997 | DeZorzi |
| 5,680,718 | A | 10/1997 | Ratcliffe et al. |
| 5,688,039 | A | 11/1997 | Johnson |
| 5,692,244 | A | 12/1997 | Johnson et al. |
| 5,708,449 | A | 1/1998 | Heacock et al. |
| 5,718,335 | A | 2/1998 | Boudreaux |
| 5,722,762 | A | 3/1998 | Soll |
| 5,730,290 | A | 3/1998 | Futo |
| 5,741,060 | A | 4/1998 | Johnson |
| 5,743,621 | A | 4/1998 | Mantha et al. |
| 5,758,947 | A | 6/1998 | Glatt |
| 5,786,665 | A | 7/1998 | Ohtsuki et al. |
| 5,800,278 | A | 9/1998 | Varriano |
| 5,822,636 | A | 10/1998 | Cho |
| 5,829,063 | A | 11/1998 | Cheng |
| 5,836,673 | A | 11/1998 | Lo |
| 5,845,778 | A | 12/1998 | Hickey, Jr. |
| 5,845,987 | A | 12/1998 | Painter |
| 5,857,220 | A | 1/1999 | Erny et al. |

5,865,333 A 2/1999 Wolfe
5,871,271 A 2/1999 Chien
D407,187 S 3/1999 Makki
5,876,241 A 3/1999 Frantz
5,894,604 A 4/1999 Crabb et al.
5,918,966 A 7/1999 Arnold
5,920,910 A 7/1999 Calvo
5,921,674 A 7/1999 Koczi
5,922,489 A 7/1999 Adachi
5,931,693 A 8/1999 Yamazaki
5,946,071 A 8/1999 Feldman
5,982,969 A 11/1999 Sugiyama et al.
5,997,165 A 12/1999 Lehrer
6,005,536 A 12/1999 Beadles et al.
6,007,212 A 12/1999 Chan
6,007,213 A 12/1999 Baumgartner
6,009,563 A 1/2000 Swanson et al.
6,012,822 A 1/2000 Robinson
6,012,827 A 1/2000 Caplan et al.
6,021,525 A 2/2000 Mertins
6,023,788 A 2/2000 McCallum et al.
6,028,627 A 2/2000 Helmsderfer
6,032,291 A 3/2000 Asenguah et al.
6,032,293 A 3/2000 Makki
6,056,413 A 5/2000 Urso
D428,431 S 7/2000 Jordan
6,086,214 A 7/2000 Ridge
6,087,037 A 7/2000 Rieder
6,088,053 A 7/2000 Hammack et al.
6,094,749 A 8/2000 Proctor
6,113,243 A 9/2000 Saul
6,113,244 A 9/2000 Baumgartner
6,116,745 A 9/2000 Yei
6,124,056 A 9/2000 Kimura
6,126,294 A 10/2000 Koyama et al.
6,167,570 B1 1/2001 Su
6,168,286 B1 1/2001 Duffy
6,172,657 B1 1/2001 Kamakura et al.
6,174,075 B1 1/2001 Fuwausa
6,206,543 B1 3/2001 Henry
6,236,007 B1 5/2001 Ho
6,237,147 B1 5/2001 Brockman
6,240,566 B1 6/2001 Scantlin
6,244,721 B1 6/2001 Rodriguez et al.
6,250,769 B1 6/2001 Kirk
6,256,795 B1 7/2001 Habel
6,290,368 B1 9/2001 Lehrer
6,306,538 B1 10/2001 Saitoh et al.
6,307,526 B1 10/2001 Mann
6,311,837 B1 11/2001 Blaustein et al.
6,320,822 B1 11/2001 Okeya et al.
6,325,521 B1 12/2001 Gregg et al.
6,328,454 B1 12/2001 Davis
6,340,234 B1 1/2002 Brown, Jr.
6,345,716 B1 2/2002 Chapman
6,347,410 B1 2/2002 Lee
6,363,537 B1 4/2002 Park
6,366,344 B1 4/2002 Lach
6,382,407 B1 5/2002 Chao
6,386,701 B1 5/2002 Khulusi
6,390,640 B1 5/2002 Wong et al.
6,398,386 B1 6/2002 Huang
6,416,199 B1 7/2002 Heine
6,431,904 B1 8/2002 Berelsman
6,442,764 B1 9/2002 Badillo et al.
6,457,838 B1 10/2002 Dugmore et al.
6,461,015 B1 10/2002 Welch
6,461,025 B1 10/2002 Payne
6,474,830 B1 11/2002 Hansen
6,497,493 B1 12/2002 Theisen
6,504,099 B2 1/2003 Huang
6,549,231 B1 4/2003 Matsui
6,553,570 B1 4/2003 Flynn
6,578,982 B1 6/2003 Lynch
6,598,991 B2 7/2003 Altman
6,604,837 B2 8/2003 Sandberg
6,616,293 B2 9/2003 Mickey
6,659,618 B2 12/2003 Waters
6,679,615 B2 1/2004 Spearing
6,704,044 B1 3/2004 Foster et al.
6,709,142 B2 3/2004 Gyori
6,713,956 B2 3/2004 Chen et al.
6,715,309 B1 4/2004 Junkins
6,719,437 B2 4/2004 Lary et al.
6,721,962 B1 4/2004 Polaire
D489,165 S 5/2004 Waters
6,733,150 B1 5/2004 Hanley
6,760,925 B1 7/2004 Maxwell
6,802,636 B1 10/2004 Bailey, Jr.
6,811,441 B2 11/2004 Simpson
6,817,711 B2 11/2004 Schubert
6,830,357 B2 12/2004 Lopez
6,837,590 B2 1/2005 Marston
6,860,628 B2 3/2005 Robertson et al.
6,865,285 B1 3/2005 Villa-Aleman
6,908,208 B1 6/2005 Hyde et al.
6,923,322 B2 8/2005 Lenker
6,932,216 B2 8/2005 Blaustein et al.
6,935,761 B2 8/2005 Vanderschuit
6,941,583 B2 9/2005 Yan
6,966,668 B2 11/2005 Cugini et al.
6,969,178 B2 11/2005 Zuloff
6,977,776 B2 12/2005 Volkenandt et al.
6,993,803 B2 2/2006 Chan
6,994,445 B1 2/2006 Pomes
7,000,841 B2 2/2006 Becker
7,003,353 B1 2/2006 Parkhouse
7,004,439 B1 2/2006 Taylor et al.
7,021,790 B2 4/2006 Parsons
D520,460 S 5/2006 Wadsworth et al.
7,052,154 B2 5/2006 Vanderschuit
7,086,749 B1 8/2006 Hanley
7,094,981 B2 8/2006 Sorrentino et al.
7,105,939 B2 9/2006 Bednyak
7,111,956 B2 9/2006 Brown
7,118,241 B2 10/2006 Sohn
7,118,262 B2 10/2006 Negley
7,128,434 B1 10/2006 Nally et al.
7,147,338 B2 12/2006 Gregg
7,163,309 B2 1/2007 Sohn
7,182,478 B2 2/2007 Marston
7,186,159 B1 3/2007 Baxter
7,192,151 B2 3/2007 Clupper et al.
7,234,831 B1 6/2007 Hanley
D566,044 S 4/2008 D'Arco et al.
7,369,174 B2 5/2008 Olita et al.
7,427,149 B2 9/2008 Sohn
7,431,472 B2 10/2008 Becker
7,461,764 B2 12/2008 Thompson
7,470,022 B2 12/2008 Lerner
7,506,992 B2 3/2009 Carter
D591,675 S 5/2009 Waters
7,576,800 B2 8/2009 Swain
D600,208 S 9/2009 Waters
7,598,928 B1 10/2009 Buskop
7,609,295 B2 10/2009 Aridome et al.
7,611,255 B1 11/2009 Lagassey
7,621,000 B1 11/2009 Fulton
7,661,818 B2 2/2010 Waters
7,677,751 B2 3/2010 Kinsman et al.
7,753,547 B2 7/2010 Waters
7,784,960 B2 8/2010 Lahtinen
8,333,485 B2 12/2012 Waters
8,388,164 B2 * 3/2013 Waters ..... 362/106
2001/0024365 A1 9/2001 Aknine
2002/0131275 A1 9/2002 Yamamoto et al.
2002/0159250 A1 10/2002 Kuo et al.
2002/0163800 A1 11/2002 Hansen
2002/0186557 A1 12/2002 Lary et al.
2002/0187806 A1 12/2002 Jang
2003/0079387 A1 5/2003 Derose
2003/0106918 A1 6/2003 Hung
2003/0122958 A1 7/2003 Olita et al.
2003/0151910 A1 8/2003 Marston
2003/0169207 A1 9/2003 Beigel
2003/0231489 A1 12/2003 Hsiao
2004/0008157 A1 1/2004 Brubaker et al.
2004/0141312 A1 7/2004 Henning et al.

| | | | |
|---|---|---|---|
| 2004/0165109 | A1 | 8/2004 | Lee |
| 2004/0222638 | A1 | 11/2004 | Bednyak |
| 2004/0240067 | A1 | 12/2004 | Marusi et al. |
| 2004/0240204 | A1 | 12/2004 | Russ et al. |
| 2004/0264176 | A1 | 12/2004 | Vanderschuit |
| 2005/0001433 | A1 | 1/2005 | Seelin |
| 2005/0047116 | A1 | 3/2005 | Gagne |
| 2005/0066422 | A1 | 3/2005 | Yan |
| 2005/0072458 | A1 | 4/2005 | Goldstein |
| 2005/0078473 | A1 | 4/2005 | Zuloff |
| 2005/0083676 | A1 | 4/2005 | VanderSchuit |
| 2005/0099799 | A1 | 5/2005 | Cugini et al. |
| 2005/0105285 | A1 | 5/2005 | Maden |
| 2005/0161313 | A1 | 7/2005 | Sorrentino et al. |
| 2005/0174753 | A1 | 8/2005 | Cao et al. |
| 2005/0204490 | A1 | 9/2005 | Kemp et al. |
| 2005/0211187 | A1 | 9/2005 | Harman et al. |
| 2005/0211574 | A1 | 9/2005 | Reeve |
| 2005/0213340 | A1 | 9/2005 | Suzuki et al. |
| 2005/0219837 | A1 | 10/2005 | Brown |
| 2005/0265015 | A1 | 12/2005 | Salazar |
| 2006/0037125 | A1 | 2/2006 | McDowell |
| 2006/0091784 | A1 | 5/2006 | Conner et al. |
| 2006/0092621 | A1 | 5/2006 | Lai |
| 2006/0107952 | A1 | 5/2006 | Schlosser |
| 2006/0125624 | A1 | 6/2006 | Ostrovsky et al. |
| 2006/0126323 | A1 | 6/2006 | Pomes |
| 2006/0138440 | A1 | 6/2006 | Jyo |
| 2006/0141828 | A1 | 6/2006 | Dean et al. |
| 2006/0157569 | A1 | 7/2006 | Becker |
| 2006/0158895 | A1 | 7/2006 | Brands et al. |
| 2006/0165160 | A1 | 7/2006 | Winningstad et al. |
| 2006/0198122 | A1 | 9/2006 | Senter et al. |
| 2006/0215393 | A1 | 9/2006 | VanderSchuit |
| 2006/0232955 | A1 | 10/2006 | Labine |
| 2006/0239018 | A1 | 10/2006 | Jardin |
| 2006/0263677 | A1 | 11/2006 | Tsai |
| 2006/0285315 | A1 | 12/2006 | Tufenkjian |
| 2006/0286443 | A1 | 12/2006 | Huang |
| 2006/0291193 | A1 | 12/2006 | Hill |
| 2007/0003826 | A1 | 1/2007 | Hsu |
| 2007/0048598 | A1 | 3/2007 | Huang |
| 2007/0053179 | A1 | 3/2007 | Pang et al. |
| 2007/0058361 | A1 | 3/2007 | Sevilla |
| 2007/0064413 | A1 | 3/2007 | Slater |
| 2007/0072655 | A1 | 3/2007 | Cascone |
| 2007/0074752 | A1 | 4/2007 | Shau et al. |
| 2007/0097668 | A1 | 5/2007 | Choi |
| 2007/0140675 | A1 | 6/2007 | Yanagi |
| 2007/0145746 | A1 | 6/2007 | Biamonte |
| 2007/0153537 | A1 | 7/2007 | Scott et al. |
| 2007/0159810 | A1 | 7/2007 | Kim |
| 2007/0159823 | A1 | 7/2007 | Ho et al. |
| 2007/0171628 | A1 | 7/2007 | Seade |
| 2007/0189003 | A1 | 8/2007 | Daley |
| 2007/0206373 | A1 | 9/2007 | Whiteside et al. |
| 2007/0236915 | A1 | 10/2007 | Chen |
| 2007/0236916 | A1 | 10/2007 | Hsu |
| 2008/0130272 | A1 | 6/2008 | Waters |
| 2008/0263750 | A1 | 10/2008 | Chen et al. |
| 2008/0266839 | A1 | 10/2008 | Claypool et al. |
| 2009/0147503 | A1 | 6/2009 | Bennett |
| 2009/0148149 | A1 | 6/2009 | Chishima |
| 2009/0193566 | A1 | 8/2009 | Waters |
| 2010/0214767 | A1 | 8/2010 | Waters |
| 2010/0307931 | A1 | 12/2010 | Waters |
| 2010/0313335 | A1 | 12/2010 | Waters |
| 2011/0122601 | A1 | 5/2011 | Waters |
| 2011/0210685 | A1 | 9/2011 | Liao |
| 2012/0014095 | A2 | 1/2012 | Waters |

FOREIGN PATENT DOCUMENTS

| | | | |
|---|---|---|---|
| AU | 199940150 | | 2/2000 |
| AU | 199959545 | | 3/2000 |
| AU | 2002100976 | | 6/2003 |
| AU | 2003100277 | | 7/2003 |
| AU | 2003248016 | | 11/2004 |
| CA | 2029772 | | 5/1991 |
| CA | 2198625 | | 2/1997 |
| CA | 2184336 | | 5/1997 |
| CA | 2406450 | | 11/2001 |
| CA | 2466175 | | 5/2003 |
| CN | 86208973 | | 10/1987 |
| CN | 2173427 | | 8/1994 |
| CN | 2239167 | | 11/1996 |
| CN | 2423761 | | 3/2001 |
| CN | 2433836 | | 6/2001 |
| CN | 2458892 | | 11/2001 |
| CN | 2508592 | | 9/2002 |
| CN | 2544551 | | 4/2003 |
| CN | 1462597 | | 12/2003 |
| CN | 1603677 | | 4/2005 |
| DE | 8230583 | | 9/1983 |
| DE | 29808222 | | 11/1998 |
| DE | 19837151 | | 4/2000 |
| DE | 20007738 | | 9/2000 |
| DE | 29915607 | | 9/2000 |
| DE | 20017922 | | 2/2001 |
| DE | 20020515 | | 8/2001 |
| DE | 20101380 | | 8/2001 |
| DE | 20106261 | | 9/2001 |
| DE | 20111815 | | 11/2001 |
| DE | 10046295 | | 3/2002 |
| DE | 20117740 | | 4/2002 |
| DE | 20201557 | | 5/2002 |
| DE | 20200058 | | 6/2002 |
| DE | 10103591 | | 8/2002 |
| DE | 20110124 | | 8/2002 |
| DE | 10057388 | | 9/2002 |
| DE | 20209115 | | 10/2002 |
| DE | 20210806 | | 10/2002 |
| DE | 10216152 | | 12/2002 |
| DE | 20209611 | | 1/2003 |
| DE | 20313629 | | 12/2003 |
| DE | 10330589 | | 1/2004 |
| DE | 20319297 | | 2/2004 |
| DE | 20318860 | | 4/2004 |
| DE | 20318949 | | 4/2004 |
| DE | 202004004960 | | 9/2005 |
| DE | 10 2007 006 860 | A1 | 8/2007 |
| EP | 1072204 | | 1/2001 |
| EP | 1374707 | | 1/2004 |
| FR | 1221782 | | 6/1960 |
| FR | 2798721 | | 3/2001 |
| FR | 2824709 | | 11/2002 |
| FR | 2829365 | | 3/2003 |
| FR | 2833068 | | 6/2003 |
| FR | 2833069 | | 6/2003 |
| GB | 2268043 | | 1/1994 |
| GB | 2316293 | | 2/1998 |
| GB | 2358575 | | 8/2001 |
| GB | 2363314 | | 12/2001 |
| GB | 2374401 | | 10/2002 |
| GB | 2378117 | | 2/2003 |
| GB | 2378118 | | 2/2003 |
| GB | 2388298 | | 11/2003 |
| JP | S61-006304 | | 1/1986 |
| JP | 4289602 | | 10/1992 |
| JP | H08-027610 | A | 1/1996 |
| JP | H08-298004 | A | 11/1996 |
| JP | H09-209210 | A | 8/1997 |
| JP | H09-296319 | A | 11/1997 |
| JP | H10-081275 | A | 3/1998 |
| JP | H10-331019 | A | 12/1998 |
| JP | 3084061 | | 11/2001 |
| JP | 2004-207580 | | 7/2004 |
| JP | 2005-216832 | A | 8/2005 |
| JP | 2006-097156 | A | 4/2006 |
| KR | 20-0164075 | | 2/2000 |
| KR | 200168826 | | 2/2000 |
| KR | 200260980 | | 1/2002 |
| KR | 20020065405 | | 8/2002 |
| KR | 200331201 | | 10/2003 |
| TW | 241462 | | 2/1995 |
| TW | 275188 | | 5/1996 |
| TW | 286489 | | 9/1996 |
| TW | 324234 | | 1/1998 |
| TW | 329607 | | 4/1998 |

| | | |
|---|---|---|
| TW | 386364 | 4/2000 |
| WO | 94/02043 | 2/1994 |
| WO | 97/04434 | 2/1997 |
| WO | 02/44611 | 6/2002 |
| WO | 02/062165 | 8/2002 |
| WO | 02/074398 | 9/2002 |
| WO | 02/077520 | 10/2002 |
| WO | 03/040808 | 5/2003 |
| WO | 03/047377 | 6/2003 |
| WO | 03/083811 | 10/2003 |
| WO | 2004/000054 | 12/2003 |
| WO | 2004/064555 | 5/2004 |
| WO | 2004/103104 | 12/2004 |
| WO | 2005/002378 | 1/2005 |
| WO | 2005/005882 | 1/2005 |
| WO | 2005/038337 | 4/2005 |
| WO | 2005/096856 | 10/2005 |
| WO | 2005/098314 | 10/2005 |
| WO | 2006/037845 | 4/2006 |
| WO | 2006/124928 | 11/2006 |
| WO | 2007/073047 | 6/2007 |
| WO | 2007/073219 | 6/2007 |
| WO | 2007/089236 | 8/2007 |
| WO | 2007/093348 | 8/2007 |
| WO | 2007/112338 | 10/2007 |
| WO | 2008/011750 | 1/2008 |
| WO | 2009/079656 | 6/2009 |
| WO | 2010/099504 | 9/2010 |
| WO | 2011/137400 | 11/2011 |
| WO | 2011/137406 | 11/2011 |

OTHER PUBLICATIONS

Docket report of *Waters Industries, Inc.* v. *Totes Isotoner Corporation, et al.*, United States District Court for the Northern District of Illinois, Case No. 1:10-cv-04487 filed Jul. 19, 2010 (4 pages).

"Complaint", *Waters Industries, Inc.* v. *Totes Isotoner Corporation, et al.*, United States District Court for the Northern District of Illinois, Case No. 1:10-cv-04487 (Jul. 19, 2010) (26 pages).

Written Opinion of the International Searching Authority and International Search Report from the International Bureau of WIPO for International Application No. PCT/US2006/018968, dated Oct. 16, 2006, 12 pages.

Notification of Transmittal of the International Search Report and the Written Opinion of the International Searching Authority, or the Declaration from the International Bureau of WIPO for International Application No. PCT/US2008/087542 dated May 4, 2009, 12 pages.

Notification of Transmittal of the International Search Report and the Written Opinion of the International Searching Authority, or the Declaration from the International Bureau of WIPO for International Application No. PCT/US2010/025689 dated May 4, 2010, 14 pages.

Notification of Transmittal of the International Search Report and the Written Opinion of the International Searching Authority, or the Declaration from the International Bureau of WIPO for International Application No. PCT/US2011/034686 dated Aug. 1, 2011, 16 pages.

* cited by examiner

FIG. 10
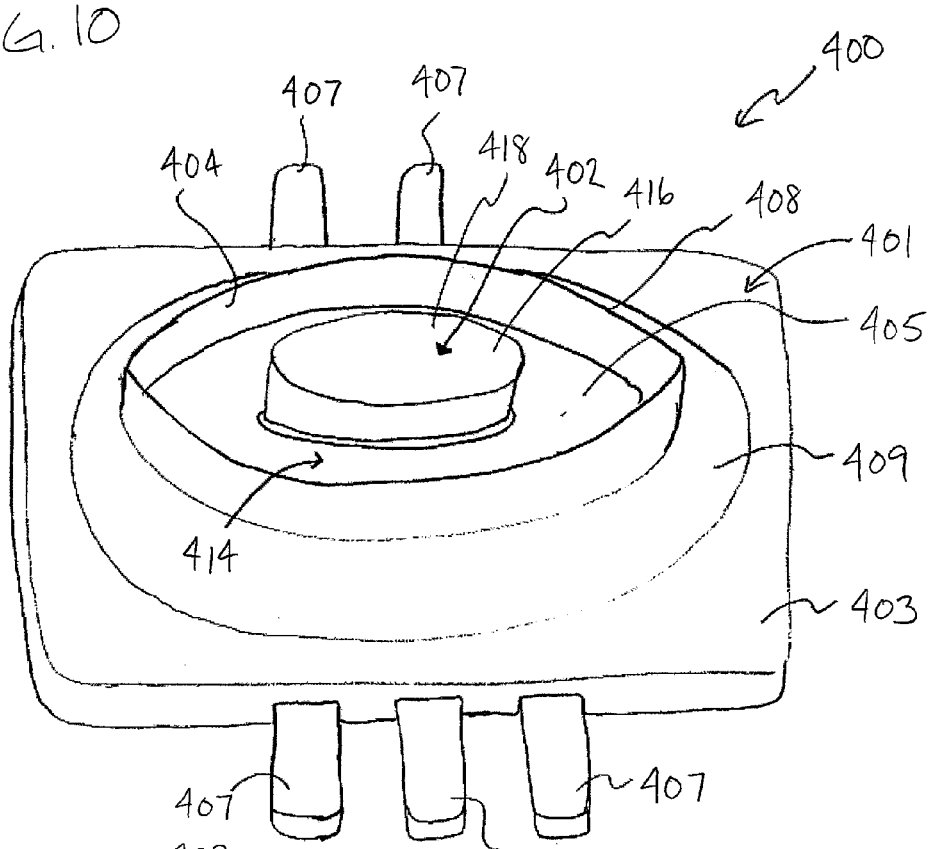
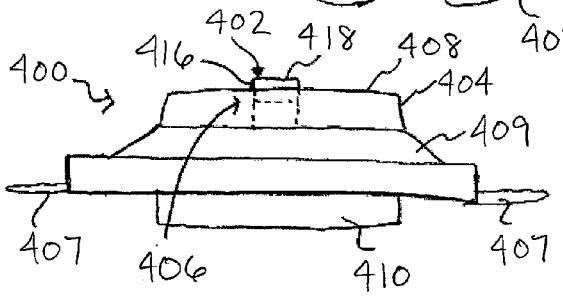
FIG. 12
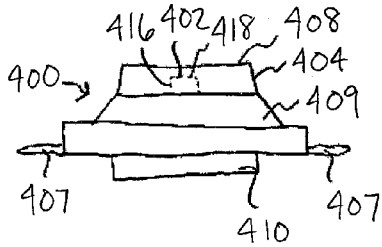
FIG. 11

ILLUMINATED HEADGEAR HAVING SWITCH DEVICES AND PACKAGING THEREFOR

CROSS REFERENCE TO RELATED APPLICATIONS

This application is a continuation-in-part of U.S. application Ser. No. 12/829,786, filed Jul. 2, 2010, now U.S. Pat. No. 8,333,485 which is a divisional of U.S. application Ser. No. 12/363,130, filed Jan. 30, 2009, now U.S. Pat. No. 7,753,547, which is a continuation of International Application Number PCT/US08/87542, filed Dec. 18, 2008, which claims the benefit of U.S. Provisional Application No. 61/014,726, filed Dec. 18, 2007, which are all hereby incorporated herein by reference in their entirety; this application also claims the benefit of U.S. Provisional Application No. 61/330,185, filed Apr. 30, 2010, which is hereby incorporated by reference herein in its entirety.

FIELD

This disclosure relates to hands-free lighting devices and, in particular, to lighted hats, control devices thereof, and protective guarding therefor.

BACKGROUND

Often an individual desires a light focused to illuminate an area while performing a task or light directed in a general outward direction for visibility. Holding a flashlight is an option, but such lighting devices are often cumbersome and may detract from the task being completed because the flashlight needs to be held to direct light at a work site where the user needs illumination. As a result, hands-free lighting is often used because the individual desiring illumination does not need to hold the light source.

Lighted headgear may include illumination sources mounted to various types of headgear and hats. Light sources can include one or more LEDs and can be directed in such a manner so that a field of view is illuminated. Applicant's U.S. Pat. No. 6,659,618 discloses examples of such lighted headgear and hats. Such LED lighted headgear, which may include LEDs mounted to a typical baseball-style cap, are convenient for hands-free lighting in a number of recreational activities.

Lighted headgear may include separate components, such as one housing or assembly to hold a power source and other electrical components and a separate housing or assembly to contain the illumination source. Other lighted hats may contain all electrical components within a crown and/or brim portion of the hat. In each case, the lighted headgear includes a light switch or switch device that is operable to establish electrical communication between the power source and the illumination source. The illumination source can be energized once the switch actuator is depressed, slid, or otherwise shifted to an on position. For example, it is known to place a push button switch underneath the fabric covering the rigid brim material.

In many cases, the lighted headgear is displayed on a store shelf in a manner so that a potential purchaser can operate the switch to turn on the light source. To this end, the hat may be provided to the store with a power source already included so that the light source can be energized by the consumer. While this configuration provides the consumer with an opportunity to view the operation of the energized light source, the light source can be left in an "on" state on the shelf, which undesirably drains the power source. Additionally, because the lighted headgear may be shipped in bulk to the store with the power source included, the light source can also be unintentionally energized through contact of the switch actuator with an adjacently packed hat, shipping container, or shelf. In particular, where the light switch is mounted to the hat brim, it has been found that the light source can be inadvertently energized during the shipping process by the hat brim of one hat engaging or depressing the switch actuator of another hat nested therewith. Such inadvertent energization can drain the power source prior to the hat's display on the store shelf.

If the power source is completely drained by such events, a subsequent consumer would not be able to try the lighted features of the hat and would be required to purchase a new power source, which can dissuade the consumer from purchasing the hat. If the power source is only partially drained, the light sources may receive a reduced power flow which can undesirably reduce the brightness of the light sources, and/or a consumer would be able to try the lighted features of the hat, but would be faced with a shortened power source life after purchase. Both of these scenarios can hurt consumer goodwill and result in negative feedback.

Prior packaging arrangements have been configured to allow actuation of a switch to momentarily activate a power source while an item is encased with the packaging, but such prior packaging is generally a blister-type pack that completely encases the product so that it tends to be bulky and distracts from the appearance of the item within the package. Moreover, such prior blister-pack arrangements generally do not have packaging that will substantially prevent inadvertent actuation of the switch that might cause power to drain from the battery. Therefore, when these prior packaging designs are shipped in bulk, there is the risk that engagement between adjacent packages could energize the light source and drain the battery.

For example, U.S. Pat. No. 6,311,837 to Blaustein discloses a bulky blister pak for an electric toothbrush that allows momentary activation of the toothbrush while within the packaging material by permitting a switch actuator to be depressed momentarily, but attempts to block continuous actuation of the power source by hindering the sliding of the switch actuator to a permanently "on" position. To this end, Blaustein permits the momentary depressing of its switch actuator by relying on the flexibility of the blister pak material covering the switch actuator that can easily deform to allow the switch actuator to be depressed, but then includes a single, narrow rib adjacent to one side of the momentary switch to prevent the sliding action of the switch actuator to the continuously "on" position.

Blaustein's single rib is designed to primarily block the switch actuator from shifting or sliding in a direction along the shaft of the toothbrush to prevent the switch actuator from being shifted to the continuously "on" position. Although this packaging arrangement may be effective to prevent the switch actuator from being slid to the continuously "on" position, the blister pak has a relatively flexible material surrounding the switch in order to permit the momentary actuation of the switch. Therefore, inadvertent actuation may still occur when multiple items having this packaging arrangement are stacked atop one another. When sufficient items are tightly packed in a box or other shipping crate, a force between packed items may be sufficient to deform of the thin blister pak material covering the switch to depress the switch to the momentary "on" position. Therefore, Blaustein's switch can be inadvertently depressed to the momentary "on" position and the power source drained.

SUMMARY

There is provided lighted headgear, components thereof, and other accessories combined with the lighted headgear. The lighted headgear includes baseball-style caps, visors, or the like. One such type of lighted headgear includes a head reception portion and a brim portion extending outwardly from a lower forward edge of the head reception portion. One or more light sources are mounted to at least one of the head reception portion and the brim portion, such that the one or more light sources project light outwardly from the lighted headgear. By one approach, the lighted headgear can further include at least two switch devices mounted thereto, the switch devices both capable of controlling operation of light sources mounted to the headgear. The two switch devices can include a temporary switch device configured to temporarily energize the light sources and a maintained switch device configured to select either on or off states of the light sources. The switch devices may include a variety of forms of switch devices, including pushbutton switches, slide switches, rotary switches, contact switches, touch sensor switches, or the like. These switch devices may incorporate electronic devices, such as circuit boards, resistors, etc. Similarly, the function of the switch devices can be implemented by software via a circuit board and/or microchip. The lighted headgear may further include various accessories for use therewith, such as packaging designed to allow a consumer and potential purchaser to energize light sources mounted to the headgear. Such "try-me" features are important sources of goodwill with consumers.

In one form, the lighted headgear includes a head reception portion and a brim portion that extends away from a forward lower edge portion of the head reception portion. A power source, such as one or more batteries, is mounted to the head reception portion or the brim portion and at least one light source is mounted to the brim portion. The lighted headgear further includes the temporary switch device and the maintained switch device. The switch devices are mounted to the head reception portion or the brim portion of the lighted headgear to operate the light sources. The maintained switch device is configured to allow a user to shift the switch device to select on or off states of the light source. When the maintained switch device is shifted, the light source stays in the selected state after the switch device is released by the user. The temporary switch device is configured to allow a user to shift the switch device to temporarily select the on state of the light source. The light source temporarily remains in the on state and returns to the off state due to release of the temporary switch device. In a preferred form, the light source remains in the on state as long as the temporary switch device is held in a shifted configuration, but returns to the off state upon release of the switch device.

In one example, the switch devices are disposed on the brim portion and have buttons or plunger actuators extending away from the brim portion that are configured to be depressible toward the brim portion for operating the light source, as discussed above. Shifting or depression of the button or plunger actuator of the maintained switch device allows a user to select on and off states, which may include a number of alternative lighting modes or configurations, such as blinking, colors, different combinations of lights, etc., upon repeated depressions of the switch device plunger. With the maintained switch device, the light source remains in the selected on state until the user depresses the plunger actuator switching the light source to the off state.

The maintained switch device and the temporary switch device can share a common electrical circuit for providing an electrical connection with the power source and the light source. The common electrical circuit can be configured such that when the maintained switch device has been shifted and the light source is in the on state, shifting and releasing of the temporary switch device will not cause the light source to return to the off state. By another approach, the common electrical circuit can be configured such that when the maintained switch device has been shifted and the light source is in the on state, shifting of the temporary switch device to the on position causes the light source illumination to increase in intensity due to an increase in power being supplied to the light source, with the light source returning to its original on state intensity after release of the temporary switch device.

In another form, lighted headgear with a head reception portion and a brim portion extending from a forward lower edge of the head reception portion is described. The lighted headgear includes a power source and multiple electrically operable devices mounted thereto, which can include, for example, a light source, a digital camera, a video camera, a recording device, an MP3 player or other music player device, a Bluetooth headset, or the like powered by the power source. The headgear further includes a first actuator device operably coupling the power source with at least one of the multiple electrically operable devices to allow a user to operate the at least one electrically operable device. The headgear also includes a second actuator device mounted thereto operably coupling the power source with either the at least one electrically operable device operated by the first actuator device or another one or more of the multiple electrically operable devices. As such, the second actuator device is configured to allow a user to operate either the at least one electrically operable device operated by the first actuator device or the other one or more electrically operable devices. A guard device is associated with the first actuator device and is configured to be disposed at least partially about the first actuator device to minimize unintentional actuation thereof, while also providing an access opening to allow access to the first actuator device for intentional actuation thereof. A cover member is associated with the second actuator device and removably mounted to the headgear to deny access to the second actuator device until the cover member is removed.

By one approach, the multiple electrically operable devices are light sources mounted to the brim portion of the headgear. With this configuration, the first actuator device can be configured to be an on/off switch device configured to control energy provided to the light sources to switch between on and off states thereof. Next, the second actuator device can be configured to be a temporary light switch to temporarily energize the light sources, such as a momentary switch, a timed switch, or the like.

By one approach, the switch guard device includes an outwardly facing distal surface positioned closely adjacent to the temporary switch device and spaced from the brim portion by a distance greater than the depressed actuation position of the temporary switch device actuator at which the light source is energized. Specifically, to energize the light sources with the temporary switch device, a user depresses the button or plunger of the switch device toward the brim portion past the outwardly facing distal surface of the switch guard. By one approach, the switch guard is a wall that extends around the switch device, such as a generally annular wall or a series of protrusions arranged to be disposed about the switch device. The switch guard can be permanently mounted to the lighted hat, such as mounted to the brim portion, mounted to the temporary switch device, integral with the temporary switch device, or mounted to brim covering material. The switch guard can also be mounted to the lighted hat in a removable manner, such as with removable hat packaging sized to fit on the brim portion, the crown portion, or both.

There is also provided a brim sleeve for the lighted headgear that may be removably mounted to a brim portion of lighted headgear to provide product identification, such as advertising, identification of product features, or the like. The brim sleeve can also include actuation protection for two light switch devices mounted to the lighted headgear. By way of example, the brim sleeve can be thin plastic, cardboard, paperboard, and/or other fiberboard packaging cover or body capable of being detachably mounted to the brim portion of the lighted headgear. An upper portion of the brim sleeve body is configured to extend across and substantially cover a top portion of the brim portion and connect to at least one lower portion of the brim sleeve body, which is configured to extend along a lower surface of the brim portion between opposite brim side edges thereof. By one approach, the lower portion of the brim sleeve is configured to extend adjacent to or at least partially overlap one or both of the light switch devices. With this configuration, a switch cover can be mounted to the brim sleeve lower body portion to extend around and over the first light switch to substantially prevent access thereto and therefore prevent the light switch from being actuated until removal of the brim sleeve. The brim sleeve may also or alternatively include a switch guard, which can be attached to the switch cover or separately attached to the brim sleeve lower body portion to extend around the second switch device and thereby minimize inadvertent shifting thereof. In a preferred form, the switch guard is a molded plastic material having an upstanding flange or wall portion that, when mounted to the hat brim, extends away from the brim portion beyond the plunger actuator to serve as a barrier for avoiding unintentional actuation of the actuation switch. The upstanding flange or wall portion may generally encircle the switch actuator, but still has an access opening associated with the button or plunger actuator thereby providing direct and intentional access to the switch. The switch cover and/or switch guard can be a generally rigid portion of the brim sleeve body or can be separate rigid portions, such as blow-molded plastic or the like, mounted to the brim sleeve body via a mounting flange.

Such a configuration provides a sleeve sized to fit about the brim portion while generally conforming to the upper and lower brim surfaces so as to maintain a thin profile having a curvature similar to that of the brim surfaces. In addition, such compact and conforming configuration of the brim sleeve relative to the brim portion also enables a consumer to try on the hat in the store because the brim sleeve does not interfere with the crown or other head fitting portion of the hat.

In another form, lighted headgear is described with the crown and brim portion. In this form, one or more light sources are mounted to the brim portion and electrically connected to a power source mounted to the headgear. A temporary switch device is mounted to the brim portion of the hat to allow a user to temporarily energize the one or more light sources by shifting the temporary switch device. The temporary switch device is configured such that the one or more light sources de-energize upon release of the shifted temporary switch device. The headgear can further include a switch guard device associated with the temporary switch device configured to be disposed at least partially about the temporary switch device to minimize unintentional shifting thereof. The switch guard device further includes an access opening to allow access to the temporary switch device for intentional actuation thereof. The switch guard device can be integral with the temporary switch device, mounted to a brim insert, a brim covering, or packaging mounted to the brim portion.

Many lighted hats may be manufactured at the same facility and transported from the facility to a retail store for consumer purchasing in a shipping box or other crate. A convenient way to transport such lighted hats is to place a plurality of lighted hats in a nested configuration where the individual hats within the plurality of lighted hats stack atop one another such that a crown of a lower lighted hat is inserted into a crown of an upper lighted hat while a brim of the lower lighted hat overlaps at least a portion of a brim of the upper lighted hat. This nested configuration allows for convenient and efficient transportation of the plurality of lighted hats. The switch guard device is provided to minimize inadvertent actuation of the temporary switch device while still providing direct, intentional access to the switch device through the access opening. This allows a consumer to temporarily energize the light sources mounted to the lighted headgear as a "try-me" feature. Meanwhile, where a maintained switch device is included, the switch cover can deny access to the maintained switch device which substantially prevents a consumer from leaving the lighted headgear in an on state on the shelf, which drains the power source. After purchase, a consumer can remove the brim sleeve to remove the switch cover and be provided with maintained on states of the light sources.

BRIEF DESCRIPTION OF THE DRAWINGS

FIG. 10 is a perspective view of a switch device having a guard wall adjacent an actuator thereof;

FIG. 11 is a front elevation view of the switch of FIG. 10 showing the positioning of an upper end of the actuator below an upper edge of the guard wall;

FIG. 12 is a front elevation view of an alternative arrangement of the switch of FIG. 10 showing the position of an upper edge of an actuator positioned above an upper edge of a guard wall with an actuation point below the guard wall upper edge;

DETAILED DESCRIPTION

Figure 1:
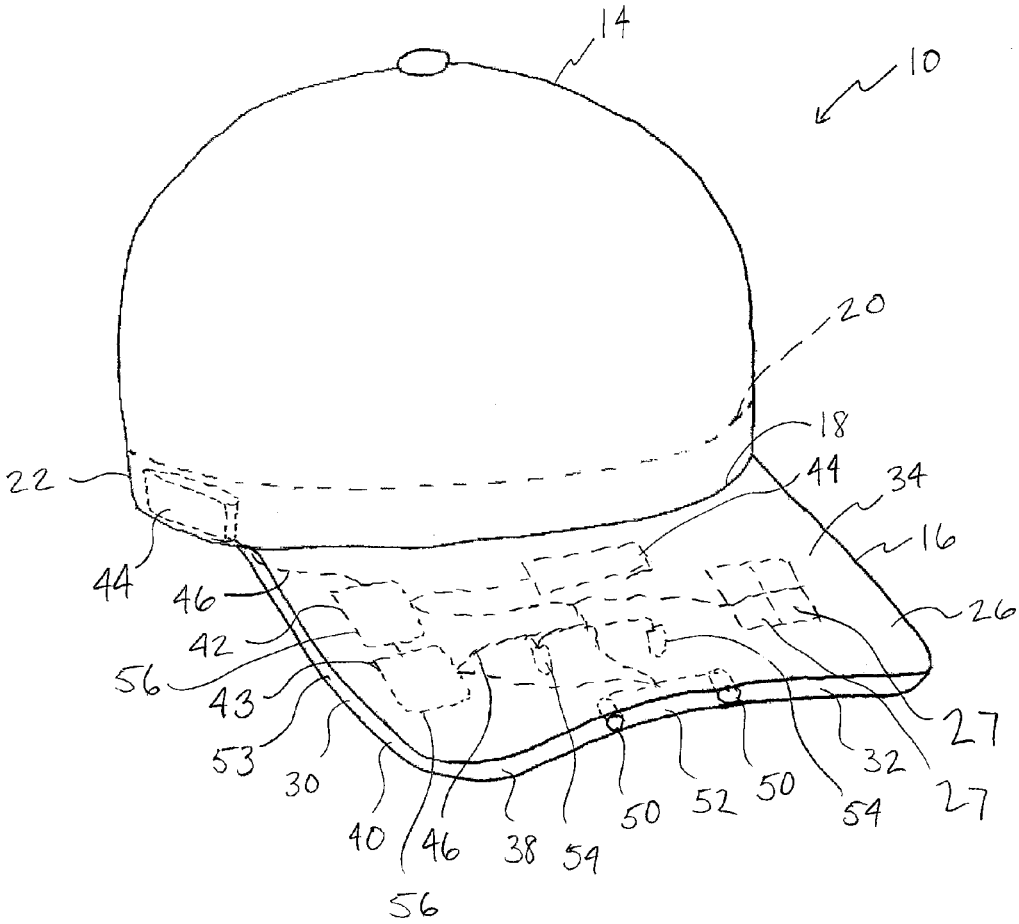
FIG. 1 is a perspective view of a lighted hat showing first and second switches mounted adjacent to one another on a brim portion of the hat.

In general, the various aspects of the disclosure herein relate to hands-free lighting, components thereof, and other accessories therefore combined with the hands-free lighting. As further described below, the hands-free lighting may include lighted headgear such as hats, including baseball caps, visors, hoods, stocking caps, and other lighted clothing items having the lights positioned thereon to provide lighting forwardly of the wearer.

In a first approach, lighted headgear is provided having first and second switch devices, both of which are configured to energize light sources provided on or mounted to the lighted headgear. A first switch device can be a maintained switch, such that the switch device is configured to shift the light sources between on and off states upon shifting thereof with the light sources remaining in the selected state after release of the switch device. One example maintained switch device can shift the light sources between an on state and an off state. Another example maintained switch device can shift the light sources between a plurality of on states, can energize different combinations of light sources, such as one or more light sources projecting light generally parallel with the brim, one or more light sources projecting light below the brim, and all light sources, and the off state. The second switch device can be a temporary switch device, such that shifting of the temporary switch device temporarily energizes the light sources mounted to the lighted hat. One example temporary switch device is a momentary switch device that energizes the light sources as long as the temporary switch device is held in an actuated or depressed state. Upon release of the temporary switch device, the light sources are de-energized to the off state. Utilizing two switch devices can provide a lighted hat with increased functionalities over previous lighted hats. The lighted hat provides sustained light directed outwardly of the hat for extended uses, but also provides temporary lighting for short uses or light pulses for signaling and the like.

In this approach, the second switch device can further include a switch guard device associated therewith to protect against unintended actuation thereof. In one form, the second switch includes a depressible plunger. In this form, the switch guard device can include a wall that at least partially extends around the plunger of the second switch and is spaced outwardly therefrom. The plunger of the second switch is sized so that an actuation position of the plunger which actuates the switch is positioned below a top edge of the switch guard. By one approach, the wall is integral with the second switch device. By another approach or in addition to the integral wall, the wall forms a part of product packaging secured to the brim.

The lighted headgear can further include a switch cover. The switch cover is positioned to prevent access to the first switch device. In one form, the switch cover is configured to be removed after purchase thereof, such as being a portion of product packaging. This allows a consumer to try the light sources via the second or temporary switch device, but also substantially prevents the consumer or other inadvertent actuation leaving the light sources on for an extended period of time. In one form, the switch cover is a part of product packaging and can be formed of a sufficiently stiff material, such as blow molded plastic or the like.

Lighted headgear packaging is also described herein, which includes the switch guard device and/or the switch cover. The packaging can be sized and configured to wrap around the brim portion and/or crown and be releasably secured thereto. The packaging can have a thin, streamlined appearance and have indicia and/or other marketing material thereon.

The lighted headgear is described herein as an exemplary lighted hat 10, such as a baseball-type cap, having a head reception or crown portion 14 and a brim portion 16 projecting forwardly from a lower, forward edge 18 of the crown 14. As discussed above, however, other headgear configurations can be utilized, such as a visor or the like. In some forms, the hat 10 may further include a hat band 20 disposed around a lower edge portion 22 of the inside of the hat 10. The hat band 20 may be composed of an elastic material to conform the crown 14 more closely to a wearer's head.

Referring now to more details of an exemplary hat, the brim 16 includes a shape-retentive brim insert 24 having an upper major surface 26, a lower major surface 28, opposite side edge portions 30, and a front edge portion 32 extending between the side edge portions 30. An upper and lower covering 34, 36, such as a fabric covering, may be disposed across the upper and lower major surfaces 26, 28 of the brim insert 24. The upper and lower covering 34, 36 may be joined together, such as by stitching, adhesive, or the like, at a perimeter edge 38 of the brim 16 with narrow piping material or other fabric material 40 having a front edge 52 and side edges 53.

The lighted hat 10 may also include a power source 44, which is illustrated as a battery package mounted adjacent to the hat band 20 of the crown 14. The power source 44 may also be mounted to other locations of the hat 10 and can take other configurations, including, for example, a rechargeable battery in the brim 16, at least one solar panel mounted to the hat 10, or other energy storage or generation devices.

The lighted hat 10 can further include one or more light sources to direct light outwardly of the lighted hat 10. The light sources can be mounted to any desired portion of the lighted hat 10, including, for example, the crown 14, the brim upper and lower major surfaces 26, 28, the brim upper and lower coverings 34, 36, the brim outboard edge 40, or the like. In the illustrated example, two light sources 50 are mounted to the forward facing edge 52 of the brim outboard edge 40. The front light sources 50 can be positioned closely adjacent each other, or spaced apart, as desired. The lighted hat 10 may further include two light sources 54 mounted to the brim lower major surface 26 to direct light to a downward and forward direction. The lower light sources 54 may be mounted to the brim as described in co-pending U.S. patent application Ser. No. 12/714,403, which is hereby incorporated by reference herein in its entirety. The light sources may take any configuration, such as the configurations described in related U.S. application Ser. No. 11/941,558, which is incorporated herein in its entirety.

One or more secondary electrically operable devices 27 can also be mounted to the brim 16 and/or the crown 14. The devices 27 can include a camera lens configured to take still photographs and/or video, an MP3 player, a Bluetooth headset, an audio recording device, an audio output device, or the like.

Figure 2:
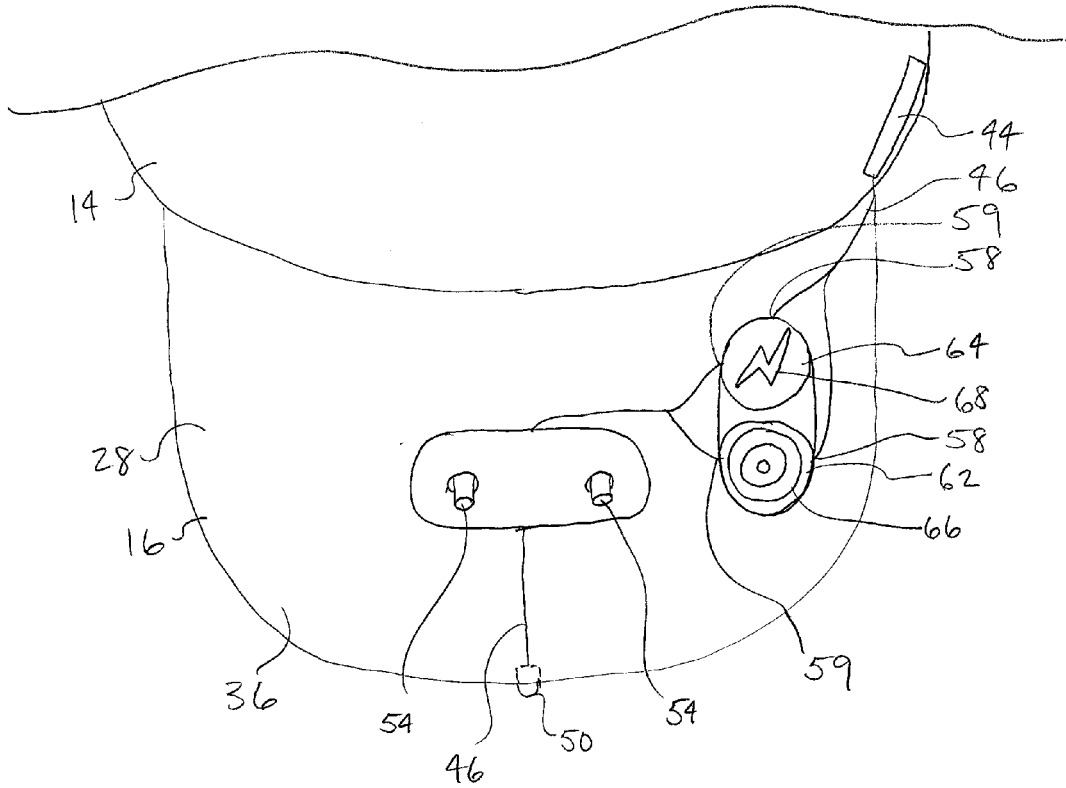
FIG. 2 is a bottom plan view of a brim of the lighted hat showing first and second switch indicia on a lower brim covering aligned with the first and second switches respectively.

The lighted hat 10 further includes first and second switch or switch devices 42, 43, which can take any desired form, including, for example, a pushbutton switch, a slide switch, a rotary switch, touch switch, or the like, as discussed above. Electrical connections or leads 46, such as wires or the like, span between the power source 44, the switches 42, 43, the light sources 50, 54, and/or the secondary electrically operable devices 27, as well as other lighted hat components, to provide power thereto. The switches 42, 43 can be disposed on any desired portion of the hat 10, such as one of the brim upper or lower major surfaces 26, 28, the brim upper or lower covering portions 34, 36, the brim perimeter edge 38, or on portions of the crown 14. As shown in FIG. 2, in one form, the first and second switches 42, 43 are mounted to the lower surface 28 of the brim 16 in a closely adjacent side-by-side relation. The proximity of the switches 42, 43 provides ease of use for a user of the lighted hat 10 because one hand location provides access to both switches and the user can easily choose one of the switches to energize the lighted hat components and/or operate the secondary electrically operable devices 27. Additionally, the switches 42, 43 are positioned to extend in a direction generally aligned with one of the side edges 53. This positioning provides convenient access for a user's left or right hand depending on the desired positioning.

In the illustrated form, the first and second switches 42, 43 are mounted to the brim between the brim lower surface 28 and the brim lower covering 36. As such, the switches 42, 43 can be secured to the brim lower surface 28 or the brim lower covering 36 as desired. Additionally, this positioning substantially hides the switches 42, 43 from view other than a slight bulging of the lower covering 36. In order to help a user locate and identify the switches, first and second switch indicator portions 62, 64 can be provided on the brim lower covering portion 36 aligned with the switches 42, 43. The switch indicator portions 62, 64 can provide a visible switch location mechanism and/or can provide a differentiating tactile feel from the other portions of the brim covering portion 36. In the illustrated form, the indicator portions 62, 64 have different indicia or patterns thereon so that a user can visibly tell the difference between the two switches and can then associate the different indicia with the function of the different switches. The indicator portions can have a design embroidered, stitched, glued, or otherwise secured to the lower covering 36 aligned with the first and second switches 42, 43 that can be easily seen by a user of the lighted hat 10 so that the switches 42, 43 can be easily accessed when light is desired. The indicator portions 62, 64 can be made of fabric, thread, plastic, metal, or combinations thereof. In the illustrated example, the first switch indicator portion 62 includes a series of concentric circles 66 and the second switch indicator portion 64 includes a lightning bolt 68, which are stitched, adhered, or otherwise secured to the lower covering portion 36. In addition to having different visual indicia, the indicator portions can also provide differentiating tactile feel. For example, the concentric circles 66 and the lightning bolt 68 can be embroidery, stitched or otherwise protrude slightly outwardly from the brim so that a user can touch the indicator portions 62, 64 to identify the switches 42, 43. So configured, a user of the lighted hat 10 can use sight or touch to determine which switch to use when using the lighted hat 10.

The light sources 50, 54 are electrically connected to the first and second switches 42, 43 with the wires 46 or other electrically conductive material. As shown, the first and second switches 42, 43 each have a separate housing 56, with separate inputs 58 from the power source 44 and outputs 59 to the light sources 50, 54. By another approach, the first and second switches 42, 43 can share a common outer housing with common inputs and outputs.

By one approach, the first switch 42 electrically connects the light sources 50, 54 to the power source 44 to thereby allow selective control over energizing the light sources 50, 54. In one form, the first switch 42 is a maintained switch and includes an actuator in the form of a plunger 60 that is configured where each depression of the plunger changes the operational state of the lighted hat 10. For example, with a lighted hat having one or more light sources, a first depression of the first switch 42 can energize the one or more light sources and a second depression can de-energize the one or more light sources. In the illustrated lighted hat having the front light sources 50 and the lower light sources 54, the first switch 42 can be configured to cycle through on states for various combinations of light sources and an "off" state for all the light sources. For example, a first depression of the first switch 42 can energize the front light sources 50, a second depression of the first switch 42 can energize the lower light sources 54, a third depression can energize both the front and lower light sources 50, 54, and a fourth depression can de-energize the light sources 50, 54. Other switch and lighting configurations can also be utilized as desired.

The second switch 43 also electrically connects the light sources 50, 54 to the power source 44 to thereby allow selective control over energizing the light sources 50, 54. In one form, the second switch 43 includes an actuator in the form of a plunger 67 that, upon depression, temporarily energizes one or more light sources on the hat. For example, the second switch 43 can be a momentary switch, a timed switch, or the like. In the illustrated form, the second switch 43 can be electrically connected to the front light sources 50, the lower light sources 54, or both. For example, a user can depress the second switch 43 to temporarily energize all of the light sources 50, 54 to provide short term illumination forwardly of the wearer. This is convenient for short uses, such as trying to locate an object in a dimly lit area.

The combination of the first switch 42 and the second switch 43 provides increased utility to a user of the lighted hat 10 over single switch lighted hats. For extended uses, the user can actuate the first switch 42 so that one or both of the front light sources 50 and/or the lower light sources 54 are energized until turned off by a subsequent depression. The second switch 43, however, provides a user with light flashes or short duration lighting, which can be utilized to quickly illuminate an area, send light signals, or the like.

As discussed above, a "try me" feature allows a consumer to energize light sources on the lighted hat to test the functionality of the hat prior to purchase. This involves including a power source with the hat and connecting an operable switch to the light sources. This configuration, however, can result in drainage of the power source when the switch is inadvertently actuated by being pressed against an adjacent surface or when a consumer energizes the light sources and fails to de-energize the light sources. The power source can also be drained during storage and transportation of the lighted hats if a surface, such as a shelf, box, or stacked hat, actuates the switch.

The lighted hat 10 described herein solves these problems through the use of the first and second switches 42, 43. In the form described above where the second switch 43 is a temporary switch, the first switch 42 can be covered during display, transportation, and/or storage to prevent maintained actuation of the light sources 50, 54. This prevents the light sources from wasting the power source with maintained lighting, while still offering a consumer a "try me" feature with the second switch 43. As discussed above, the second switch 43 only energizes the light sources for a short duration or while the switch is held in an actuated state. As such, a consumer can actuate the second switch to view the capability and lighting of the lighted hat, but once the consumer replaces the lighted hat to the shelf, the light sources de-energize and the power source is not wasted. Accordingly, a removable cover or switch block 104 is provided to block access to the first switch 42 during transportation and display of the lighted hat 10. Then, after purchase, a consumer can subsequently remove the cover 104 to access the first switch 42 and achieve maintained actuation of the light sources 50, 54.

By another approach, the first switch 42 can be connected to the secondary electrically operable devices 27 and can be a maintained or temporary switch as desired or required by a particular application. For example, the first switch 42 can operate the camera to take photographs or video, initiate and stop an audio recording or output; operate a Bluetooth headset, or the like. In this approach, the first switch 42 can be a maintained or temporary switch as desired. Additionally, the second switch 43 can be electrically connected with the light sources 50, 54 as described above.

In one exemplary hat, the switches 42, 43 share a common electrical circuit to provide an electrical connection between the power source 44 and the light sources 50, 54. The common electrical circuit is configured so that when the maintained switch 42 is shifted or actuated to turn one or more of the light sources 50, 54 to the on state, shifting or actuating the temporary switch 43 will not cause the energized light source to return to the off state.

Figure 3:
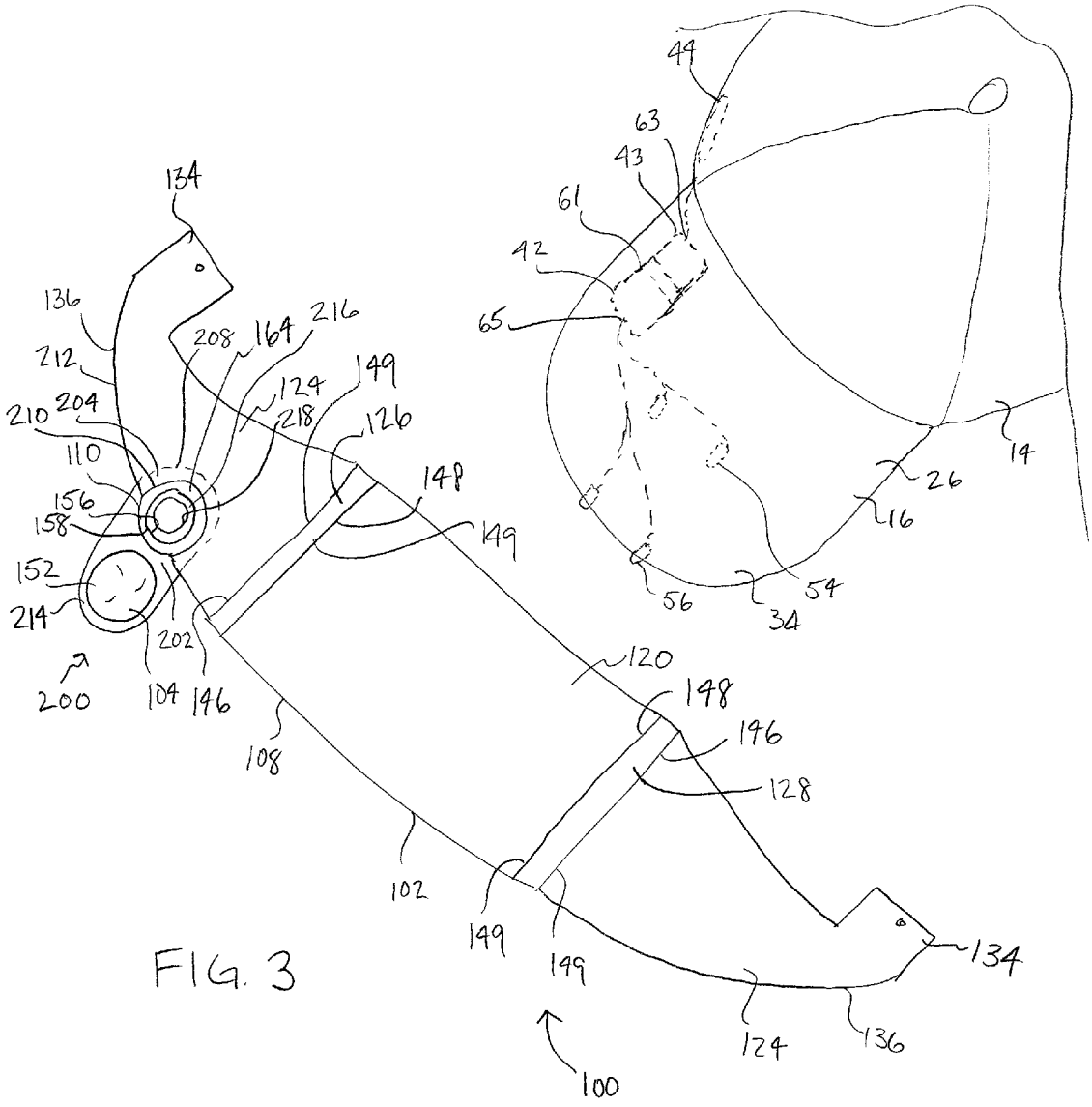
FIG. 3 is a top plan view of brim sleeve packaging and the lighted hat showing the brim sleeve packaging in an open configuration having first and second switch guards mounted thereto.
Figure 4:
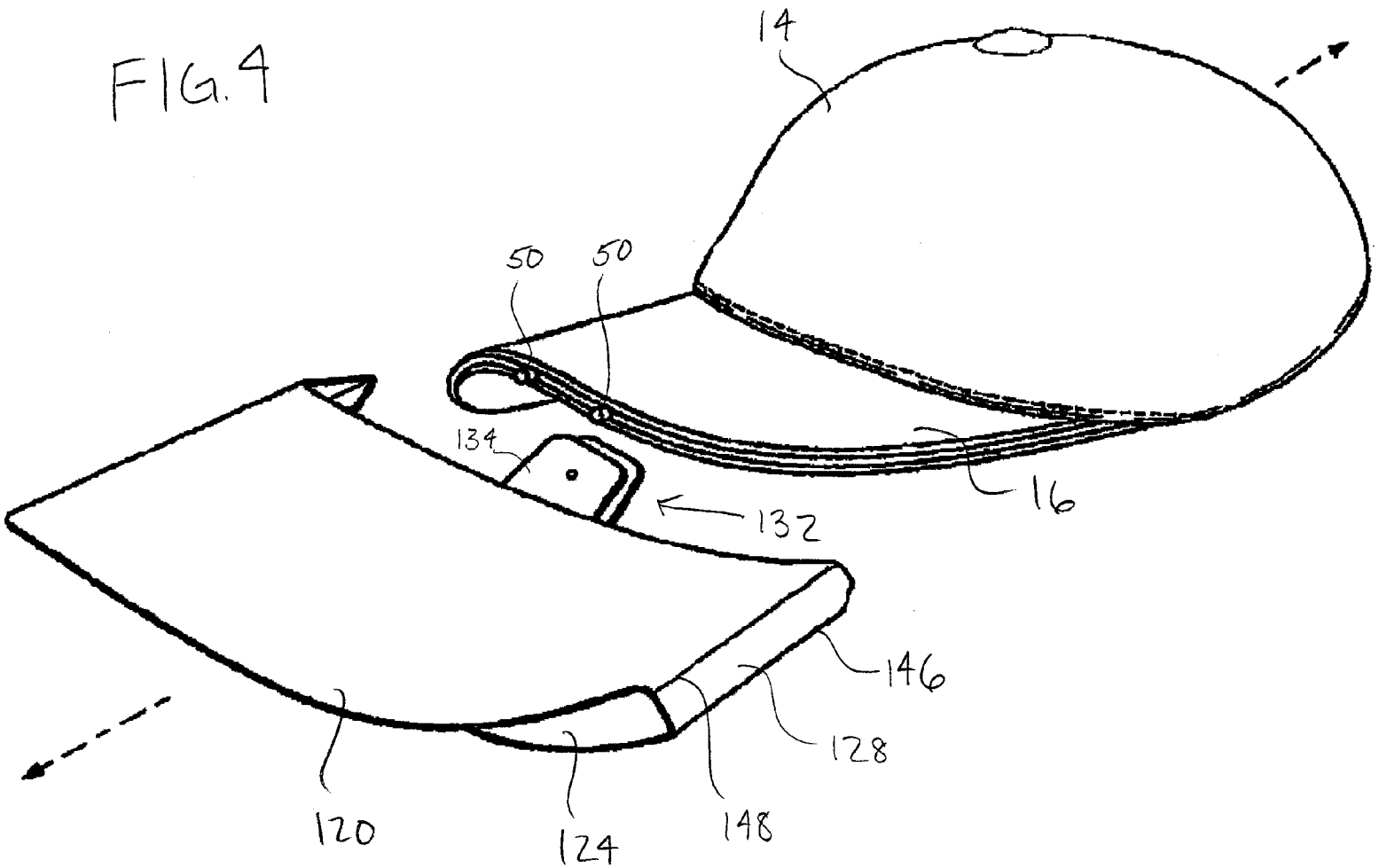
FIG. 4 is a perspective view of the brim sleeve packaging and the lighted hat showing the brim sleeve packaging in a closed configuration for being slid onto the brim of the lighted hat.
Figure 5:
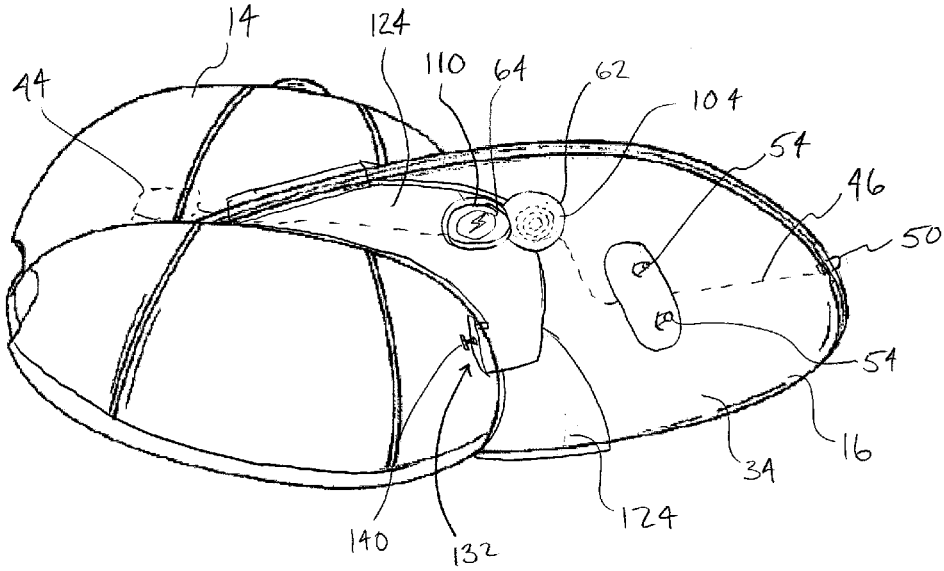
FIG. 5 is a bottom perspective view of a packaged hat including the lighted hat having the brim sleeve packaging mounted thereto showing the first and second switch guards aligned with the first and second switches of the lighted hat.
Figure 6:
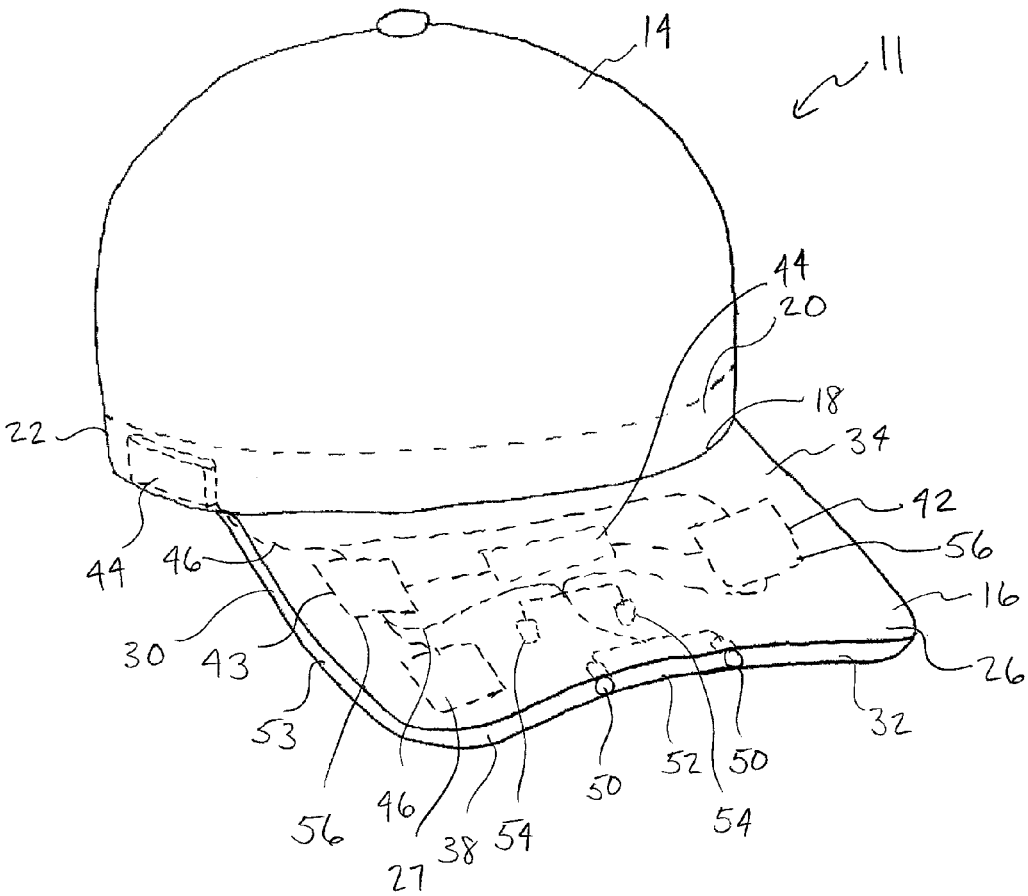
FIG. 6 is a perspective view of a lighted hat showing first and second switches mounted to opposite side portions of a brim thereof.

Referring to FIGS. 3-5, lighted hat packaging 100 is shown. A guarding or covering device 102 preferably in the form of a brim sleeve is illustrated for use in combination with the lighted hat 10 for providing a packaging cover for the hat and for providing a barrier to hinder or prevent actuation of the first switch 42 on the lighted hat 10. The brim sleeve 102 is advantageous because it provides both a packaging cover for the hat 10 to provide information about the hat 10 and, at the same time, protects against actuation of the first switch 42, which enables the power source 44 or other battery to be installed in the hat 10 during manufacture or assembly thereof and displayed at a retail store without the risk of the installed power source being drained as a result of the hat 10 being left in a maintained "on" configuration.

As shown in FIGS. 3-5, a configuration is shown suitable for the side-by-side switch configuration shown in FIG. 2. The brim sleeve 102 includes a detachable covering 108 that secures to the hat 10 and the cover 104 for protection against actuation of the first switch 42. Turning to more of the details, the detachable covering 108 of the guarding device 102 effectively forms a sleeve that encircles the hat brim 16 and includes a body 103 (FIG. 4) such as of cardboard, paperboard, and/or plastic material having a top or major surface portion 120 configured to conform to an upper curvature of the upper major surface 26 of the hat brim 16 and is sized to extend across the upper major surface 26 of the brim 16 (FIG. 4). The brim sleeve body 103 also includes a pair of flap arms or side portions 124 extending from opposite side ends 126 and 128 of the body top portion 120. The flap arms or side portions 124 are configured so as to fold under the top portion 120 as generally illustrated in FIG. 5. Preferably, the flaps 124 have a length sufficient so that they overlap each other when in the folded configuration under the hat brim 16 as best shown in FIG. 5. In this manner, when mounted to the hat 10, the brim sleeve top portion 120 extends across the upper major surface 26 of the hat brim 16, and the brim sleeve arm side portions 126 are configured to fold under the brim 16 at the brim side edges 53 and extend across the lower major surface 28 of the hat brim 16 as best shown in FIG. 5. To this end, the packaging cover body 108 may include various folds, creases, bends, or other areas of weakness as needed to permit the arm flaps 124 to easily bend or fold around the brim edges 53.

The opposite side ends 126 and 128 of the brim sleeve are generally of the same thickness as the hat brim 16 (FIG. 4) and connect/extend between the brim sleeve top portion 120 and the flap arms or side portions 124 such that the detachable covering 108 may maintain a profile similar to the hat brim 16 when mounted thereto. To this end, the opposite side ends 126 and 128 each may have a lower edge 146 and an upper edge 148 that connect between the side portion 124 and the top portion 120, respectively. Both the lower edge 146 and the upper edge 148 may contain score lines, folds, creases, perforations, or other areas of weakness therealong to facilitate bending of the cardboard or paperboard material of the brim sleeve body 103, which allow the opposite side ends 126 and 128 to maintain a similar profile and thickness as the brim edge 53.

Each of the flaps 124 permits the covering 108 to be detachably mounted to the hat 10. By one approach, each flap 124 also includes a fastening member 132 in the form of a rearwardly extending strip 134 located adjacent the distal ends 136 of the flaps 124 (FIGS. 3 and 4). As best shown in FIG. 4, the strips 134 are configured to overlap each other and be wrapped or folded adjacent to the hat band 20 within the hat crown 14. The strips 134 can either be inserted into the headband and/or fastened thereto via a fastener 140, such as a staple, pin, barb, snap, strap, adhesive, or the like extending through both strips 134 and the fabric material forming the hat band 20. By overlapping the strips 134 and fastening them to the hat band 20, the guarding device 102 can be removably mounted to the brim 16 because the guarding device 102 can be removed from the hat 10 simply by removing the fastener 140 and unfolding the strips 134 and flaps 124 from around the brim 16. By another approach, the guarding device 102 can be removed from the hat 10 by removing the fastener 140 and sliding the guarding device 102 forwardly off of the brim portion 16. In this manner, the covering 108 and guarding device 102 thereof can be secured to the hat 10 without detracting from the hat's appearance by forming a sleeve encasing the hat's brim only. To this end, by securing the covering 108 to the hat as provided herein, the hat can be tried on by a consumer in the store because the brim sleeve 102 conforms to the hat's profile and does not hinder or block the hat's crown portion 14. Additionally, the brim sleeve 102 can also be utilized on headgear having various head reception portions, such as visors or the like.

The body 103 of the brim sleeve 102 is preferably a paper, cardboard, fiberboard, plastic, laminate or other conformable packaging-type material that is sufficiently flexible and can be folded at the ends 126 and 128 rending it capable of conforming to the curvature of the hat brim 16. To this end, the covering 108 may include score lines, folds, creases, perforations or other indents 149 to permit easier folding and to define intersections between the adjacent cover sections. The top surface 120 of the detachable covering 108 may also include a decorative outer layer to be used for various markings and other indicia such as labels, logos, and other instructions so that the brim sleeve 102 also functions as a product identifier or marketing label. For instance, the top surface may indicate that the light source may be tested by suggesting the hat includes a "try me feature," as discussed above.

Figure 13:
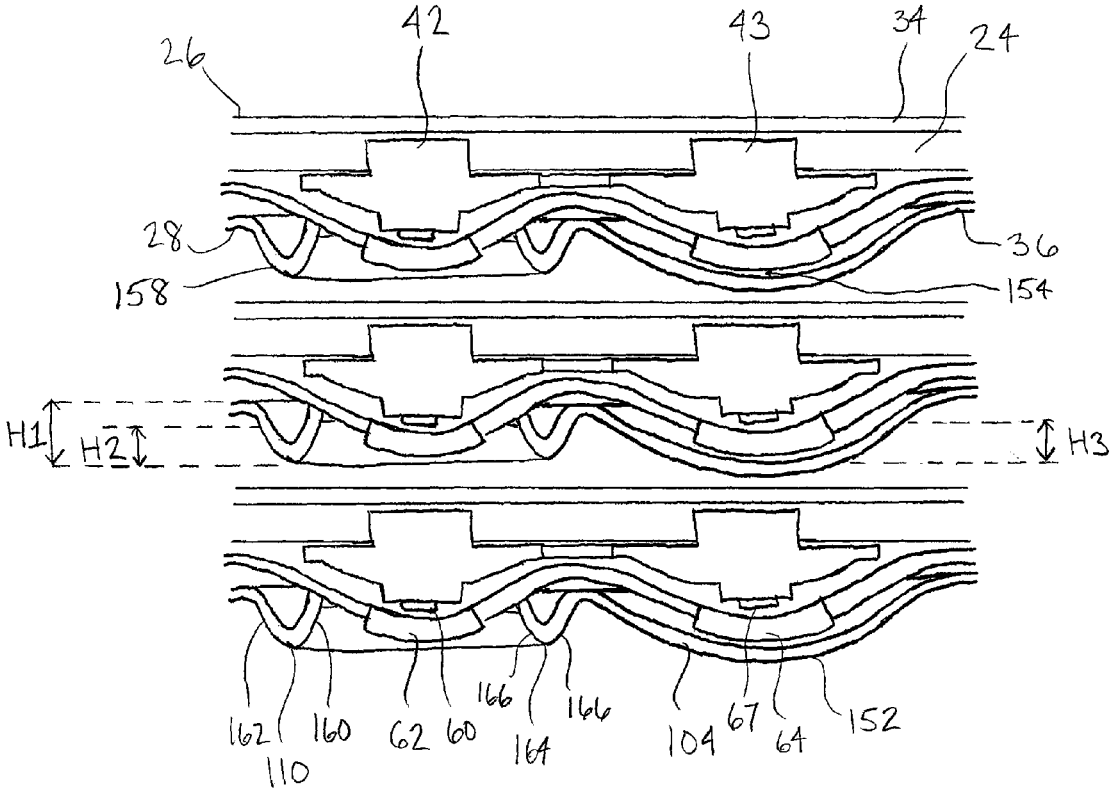
FIG. 13 cross-sectional view of a plurality packaged hats showing first and second switch guards spacing first and second switches from adjacent brims to avoid accidentally actuating the first and second switches.
Figure 14:
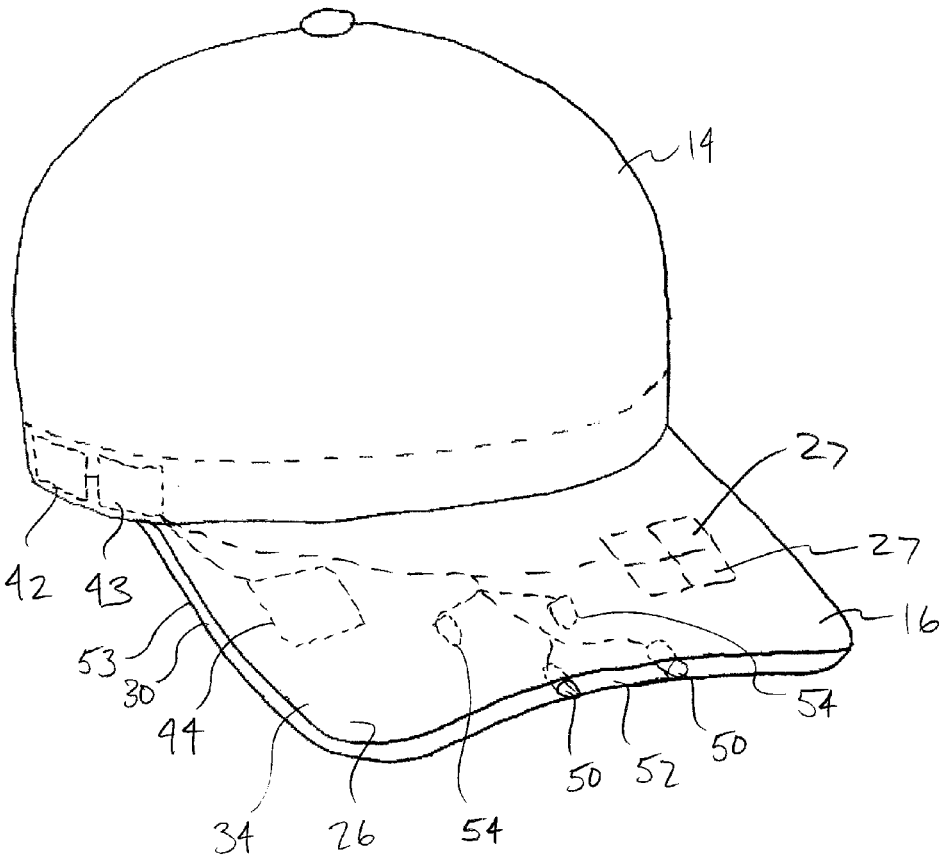
FIG. 14 is a perspective view of a lighted hat showing first and second switches mounted to a crown portion of the hat.

So configured, the brim sleeve 102 can include the switch blocking portion or cover 104 or have the cover 104 mounted thereto, so that the cover 104 can be detachably secured to the hat 10. The cover 104 is configured as a protective barrier that extends about and over the maintained switch 42, and preferably over the entire maintained switch 42, so that an adjacent surface (such as a table, wall, shelf, other nested hat 10*a* as shown in FIG. 13) or a consumer cannot actuate the maintained switch 42 prior to removal of the cover 104. In a preferred form, the cover 104 is a dome with an axis extending generally perpendicular to the brim portion 16. In this form, the actuator of the maintained switch 42 can be generally aligned with the dome axis.

In this manner, the hat 10 can be shipped to a store having the power source 44 installed therein without risking unintentional actuation of the maintained switch 42 when the hat is contacted by an adjacent surface and can be displayed at a store without risking intentional and unintentional actuation of the maintained switch 42 by a shelf or consumer. In the approach set forth above where the first switch 42 is operably connected to the secondary electrically operable devices 27, the cover 104 can substantially prevent a consumer from operating the secondary devices 27. While the cover 104 is particularly useful in a configuration designed for the baseball-style hat as shown in the figures, it will be appreciated that the guarding device 102 may also be configured for other types of headgear in a similar fashion.

The cover 104 can be effective in blocking actuation of several types of switches, such as push button switches, slide switches, rotary switches, or the like. By one approach, the cover 104 includes a lower edge portion 150 (FIG. 13) that can be positioned adjacent to and, preferably, partially or completely surround the maintained switch 42. The lower edge portion 150 can be mounted adjacent to the hat brim 16 so that it prevents lateral access to the maintained switch 42. From the lower edge portion 150, the cover 104 extends over the maintained switch 42 with a substantially unbroken rigid wall 152 to prevent access to the maintained switch 42. As illustrated, the lower edge portion 150 is generally annular and the wall 152 is a dome with a height sufficient to provide headspace 154 above the maintained switch 42. So configured, even though the wall 152 can have a rigid structure, a slight deformation of the dome would not actuate the maintained switch 42. Alternatively, the wall 152 can extend generally parallel with the hat brim 16 to form a generally flat outer surface connecting the lower edge portion 150. By one approach, when the lower edge portion 150 is generally annular, the wall 152 presents a flat outwardly facing generally circular surface.

Additionally, the brim sleeve 102 can also be provided with a barrier wall or shielding member or portion 110 for protection against accidental actuation of the temporary switch 43. The shield 110 protects the temporary switch 43 from unintended actuation but, at the same time, still permits direct and intentional actuation of the temporary switch 43 by a potential purchaser or other user. That is, the shield 110 is configured as a guarding device or protective barrier that is adjacent to and, preferably partially or completely surrounding the temporary switch 43 so that an adjacent surface (such as a table, wall, or other nested hat 10*a* shown in FIG. 13) will not cause the temporary switch 43 to be inadvertently depressed because the shield 110 keeps the adjacent surface spaced a predetermined distance from the temporary switch 43 and, thus, restricts the adjacent surface from contacting the temporary switch 43. At the same time, the shield 110 also defines an access opening 156 sized to provide direct and intentional access to the temporary switch 43 for a user to intentionally actuate the temporary switch 43.

In this manner, the hat 10 can be shipped to a store having a power source 44 installed therein without the risk of the unintentional activation of the power switch when the hat is contacted by an adjacent surface (such as with multiple hats nested together) that could drain the battery prior to the store shelf. At the same time, the shield 110 also permits the temporary switch 43 to be intentionally activated through the access opening 156 to allow a consumer to energize some or all of the light sources mounted to the hat 10 as a "try-me" feature while the hat is displayed for sale. In fact, inclusion of the shield 110 draws attention to the switch and to the "try-me" feature, increasing the consumer goodwill and the potential for purchase of the hat. While the shield 110 is particularly useful in a configuration designed for the baseball-style hat as shown in the figures, it will be appreciated that the shield 110 may also be configured for other types of headgear in a similar fashion.

By one approach, the shield 110 may be particularly effective in preventing the inadvertent actuation of the second or temporary switch 43 having a pushbutton configuration 400 with a depressible button or plunger actuator 402, such as shown in FIGS. 10-13, for energizing one or more of the illumination source 50, 54; and/or operating the secondary electrically operable devices 27, as discussed above. The temporary switch 43 is mounted to the hat brim 16, such as along the upper or lower major surfaces 26, 28 thereof. So positioned, the plunger actuator 302 of the switch 300 extends away from the brim 16 and is depressible towards the brim 16 to temporarily energize one or more of the light sources 50, 54 on the lighted hat 10 as described above. As described more below, the shield 110 effectively prevents inadvertent actuation of the temporary switch 43 by generally surrounding the switch 43 and extending away from the brim 16 a farther distance than the plunger 302 thereof.

As discussed above with respect to the cover 104, the shield 110 may be a portion of the paperboard body or, preferably, include a separate structure formed from a molded plastic that is attached to a portion of the paperboard body 103 of the brim sleeve 102. By one approach, the shield 110 includes a wall 158 having inner and outer upstanding flanges 160, 162 and an outwardly facing surface 164 spanning between distal ends 166 of the flanges 160, 162 (FIG. 13). Alternatively, the flanges 160, 162 can extend toward each other to connect at the distal ends 166 thereof. So configured, the wall 158, and specifically the inner flange 160 thereof, can be positioned adjacent to and, preferably, partially or completely surround the temporary switch 43 to minimize inadvertent actuation of the switch 43, but also provide direct access to the switch 43 through the switch access opening 156 defined. To this end, the plunger actuator 302 of the switch 300 is accessible from a direction generally transverse to the hat brim 16 and is therefore not covered by either the material forming the brim sleeve body 103 or the plastic of the shield 110. Preferably, the shield 110 is formed from a plastic material and molded into the preferred annular shape. While the shield 110 is illustrated with an annular configuration, however, it will be appreciated that the shield 110 can take any suitable configuration that at least partially surrounds or lies adjacent to the temporary switch 43 to minimize unintended actuation of the switch 43.

In the illustrated form, the shield wall 152 includes the pair of upstanding flanges 160, 162 that form an annular structure arranged and configured to encircle the temporary switch 43 after being mounted to the hat 10. The flanges 160, 162 have a tapered configuration with respect to one another to provide a relatively wide base and a relatively narrower shape for the outwardly facing surface 166. The tapered relation between the outer flange 160 and the inner flange 162 provides greater rigidity and strength to the shield wall 158.

The preferred annular shape of the shielding member 110 with the outwardly facing distal end surface 164 thereof spaced beyond the switch plunger 302 prevents inadvertent actuation of the temporary switch 43 by providing a blocking surface that abuts adjacent surfaces and substantially prevents the adjacent surfaces from contacting the switch. For example, an object having a dimension larger than the access opening 156 will abut the shield outwardly facing surface 164 and may contact various locations thereof, such as locations across from one another spanning the access opening 156 (i.e., 164*a* and 164*b* in FIG. 13). By providing at least two points of contact, the wall 142 provides enhanced resistance from being crushed or deformed upon engaging a surface.

With the side-by-side switch configuration as shown in FIGS. 1-3 and 5, the switch cover 104 and the shield 110 can advantageously be combined into a single-piece construction switch protector 200 and attached to the brim sleeve body 103. With such a configuration, the cover 104 is connected to the shield 110 by a connecting bridge or portion 202 that spaces the cover 104 and shield 110 apart so that the cover 104 can be positioned over the maintained switch 42 and the shield 110 is positioned around the temporary switch 43.

By one approach, the switch protector 200 includes an outwardly extending mounting flange 204 that projects above or below the brim sleeve body 103 to be attached or secured thereto by a fastener, which can take any suitable configuration, such as staples, pins, adhesive, barbs, or the like. Additionally, a corresponding mating surface 208 can be provided on one of the brim sleeve body flaps 124 so that when the brim sleeve 102 is mounted to the lighted hat 10, the switch protector 200 extends over the maintained and temporary switches 42, 43. In the illustrated form, the mating surface 208 includes an arcuate edge portion 210 that generally conforms to the cover 104 or shield 110 depending on the location of the switches 42, 43. To this end, the mounting flange 204 preferably extends away from a side 212 of the switch protector 200 that lies adjacent to the brim sleeve body 103 in a direction generally parallel with the brim surface 26, 28. In the illustrated form, the temporary switch 43 is positioned closer to the hat crown 14 and thus the mounting flange 202 extends from a lower edge of the shield outer flange 162. If the switches were reversed, the mounting flange 202 would project from the lower edge portion 150 of the cover 104. This permits the switch protector 200 to extend away from the brim sleeve flap arm 124 and reduce the material needed to create the brim sleeve 102.

The switch protector 200 also preferably includes seating flanges for seating on the brim 16 and providing a flush engagement with the brim surface when mounted thereto. In the illustrated form, the switch protector 200 includes an outer flange 214 that extends outwardly from some or all of a circumference of the switch protector 200. The outer seating flange 214 preferably projects a direction to extend generally parallel to the brim surface 26, 28. Additionally, an inner seating flange 216 can be provided extending from a lower edge of the shield inner flange 160 on substantially the same plane as the outer seating flange 214. Preferably, the inner seating flange 216 defines an opening therein 218 to provide direct access to the temporary switch 43. So configured, the inner and outer seating flanges 216, 214 provide enhanced stability for the switch protector 200. Moreover, the mounting flange 204 may extend from a portion of the outer seating flange 214.

Figure 7:
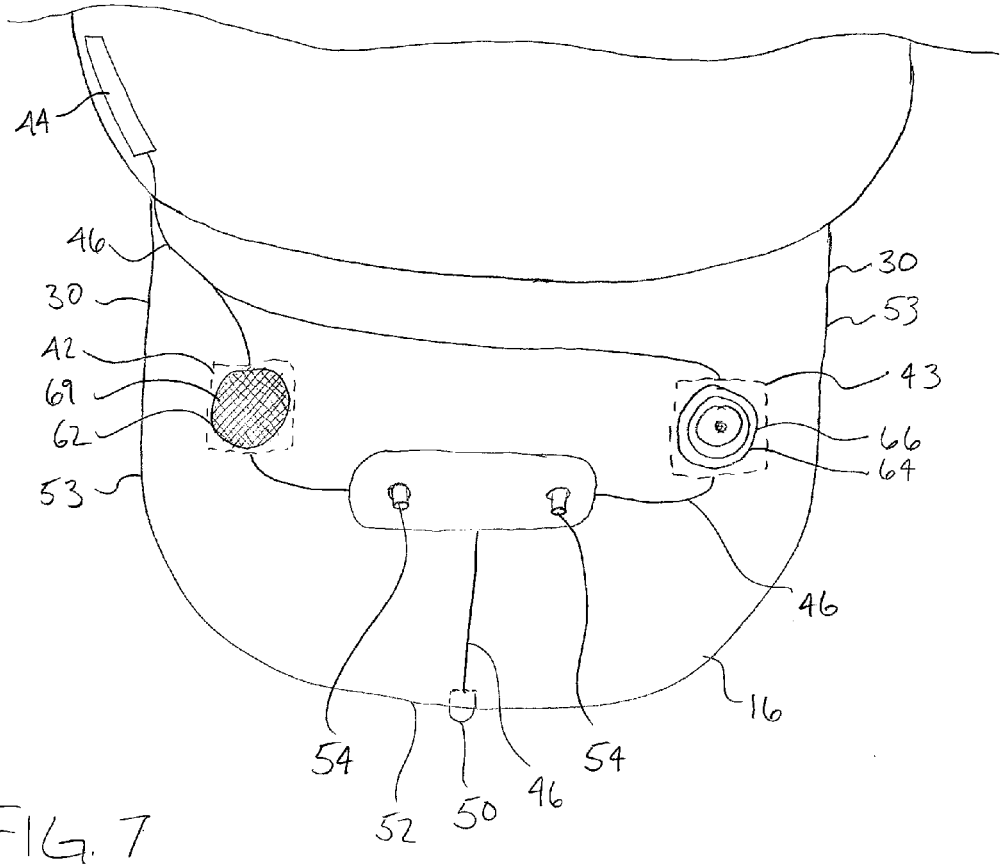
FIG. 7 is a bottom plan view of the brim of the lighted hat of FIG. 6 showing first and second switch indicia on a lower brim covering aligned with the first and second switches.
Figure 8:
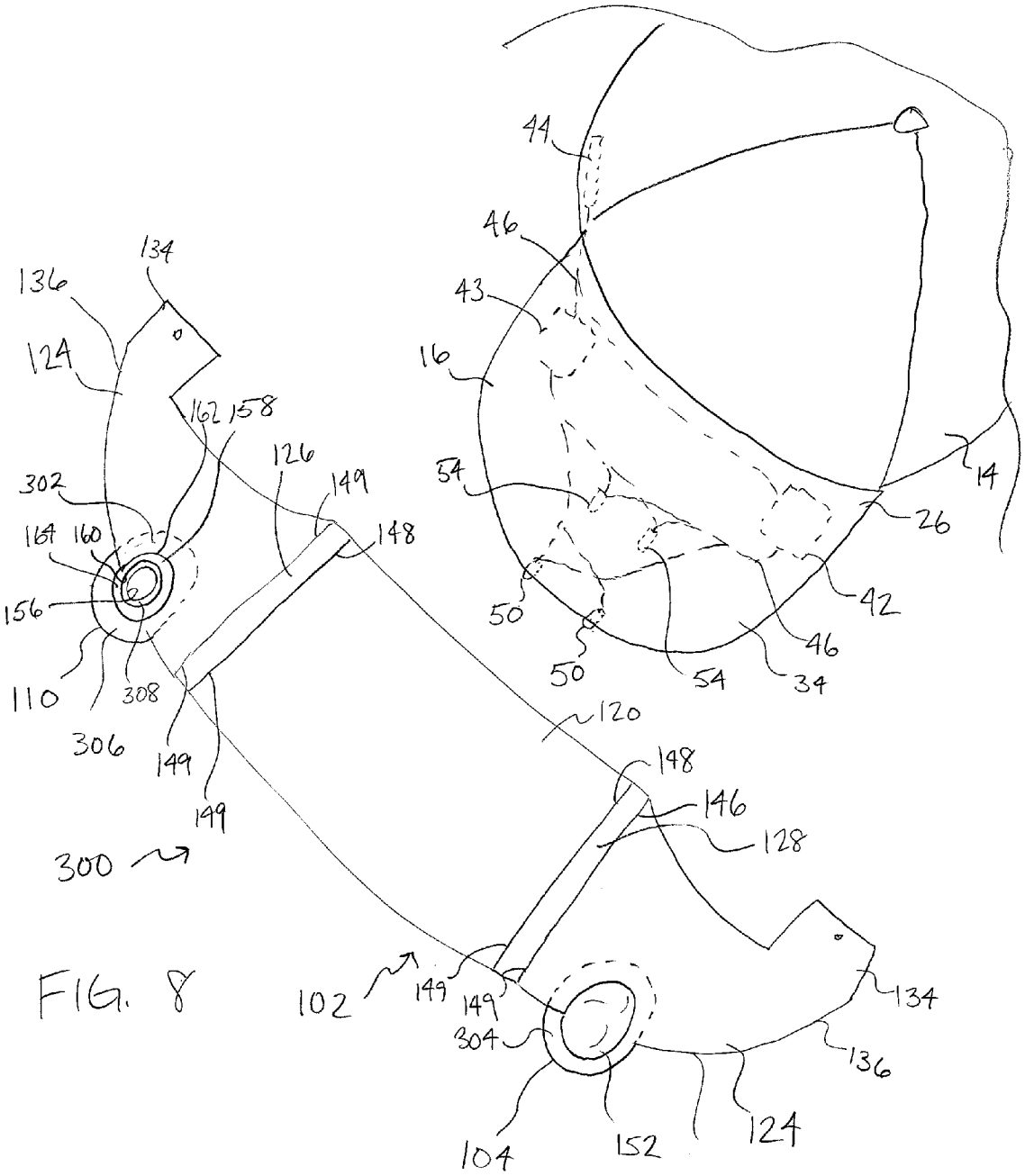
FIG. 8 is a top plan view of brim sleeve packaging and the lighted hat of FIG. 6 showing the brim sleeve packaging in an open configuration having first and second switch guards mounted thereto.
Figure 9:
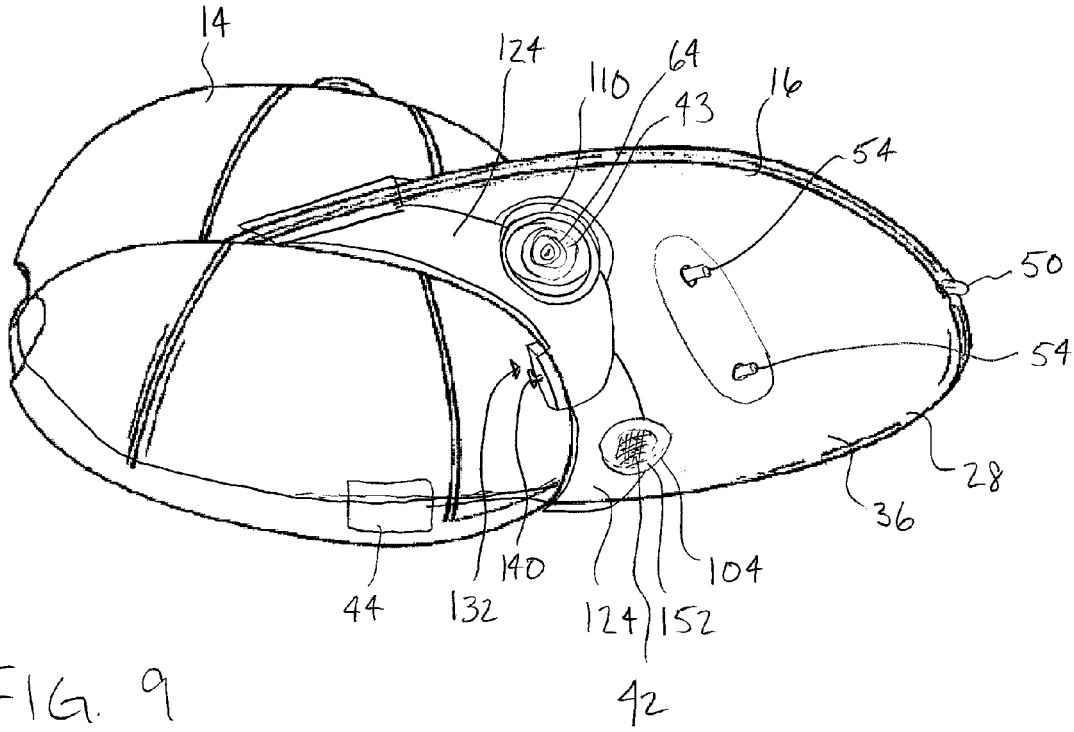
FIG. 9 is a bottom perspective view of a packaged hat including the lighted hat of FIG. 6 having the brim sleeve packaging of FIG. 8 mounted thereto showing the first and second switch guards aligned with the first and second switches of the lighted hat.

Referring now to FIGS. 6-9, an alternative switch positioning is illustrated. By this configuration, the switches are spaced apart from one another so that one switch is positioned adjacent to each brim side edge 53. This positioning separates the switches 42, 43 so that one switch is conveniently operated by a user's right hand and the other switch is operated by the user's left hand. This configuration allows a consumer to associate one side of the hat with maintained operation of the light sources 50, 54 and temporary operation of the light sources 50, 54. If desired, the switches 42, 43 could alternatively be similarly positioned on the brim upper surface 26. As shown in FIG. 7, electrical connections 46 extend between the power source 44 and the switches 42, 43 and between the switches 42, 43 and the power sources 50, 54. Additionally, in this form, the switches 42, 43 can be configured as discussed above with the associated switch indicator portions 62, 64. Yet another design for the switch indicator portion is illustrated and includes a fully embroidered portion 69.

The alternative positioning of the switches 42, 43 also causes a different arrangement 300 for the brim sleeve 102. As shown in FIG. 7, the brim sleeve body 103 is substantially the same as discussed above. The switch positioning of the lighted hat 11, however, utilizes both of the flaps 124. As discussed above, when the brim sleeve 102 is mounted to the lighted hat 11, one of the flaps 124 projects along the brim lower surface 28 from one of the brim side edges 53 and the other of the flaps 124 projects along the brim lower surface 28 from the other of the brim side edges 53 so that the flaps 124 at least partially overlap. Advantageously, with one the switches 42, 43 positioned adjacent to each of the brim side edges 53, the cover 104 and the shield 110 can be mounted to respective flaps 124 to be positioned over or around the switches 42, 43 when the brim sleeve 300 is mounted to the lighted hat 11.

As such, in this form, the cover 104 and the shield 110 are separate members or portions of the brim sleeve 102. In the separated form, the cover 110 and the shield 110 can be a plastic member configured to secure to the brim sleeve body 103. By one approach, this is achieved with a mounting flange 302 that projects from the lower edge portion 150 of the cover 104 and the outer flange 162 of the shield 110. Similarly as discussed above, the mounting flanges 302 of the cover 104 and the shield 110 are configured to project to at least partially overlap the flaps 124 of the brim sleeve body 103 to secure or mount thereto. In the illustrated form, the mounting flanges 302 project underneath the flaps 124 so that the mounting flanges 302 are positioned between the brim sleeve body 103 and the brim 16. The cover 104 and shield 110 can be mounted to the brim sleeve body 103 with the fasteners 140 discussed above.

Additionally, the cover 104 can include an outer seating flange 304 and the shield 110 can include inner and outer seating flanges 306, 308 configured as discussed above. This allows the cover 104 and shield 110 to rest flush against the brim lower surface 28 when the brim sleeve 102 is mounted to the lighted hat 11.

Turning now to FIGS. 10-12, a switch device 400 having a main body portion 401 and an upstanding actuator 402 is shown. By one approach, the actuator 402 is a push-button actuator having a plunger 416 that is depressed toward the main body 401 to actuate the switch device between on and off conditions. By one approach, the switch 400 is a temporary switch, such as the temporary switch 43 discussed above. One example form, remains in an "on" only while held in a depressed state. When a user releases the plunger 416, the switch changes to an "off" state. By another approach, the switch 400 is a maintained switch, such as the maintained switch 42 discussed above. In such a case, once the plunger 416 is depressed a first time, the switch device will remain continuously in the "on condition" until a user again depresses the plunger the switch device changes to the "off condition." Other types of actuators may also be used.

The switch device 400 includes an integrally formed and upstanding flange or guard wall 404 adjacent the actuator 402 to provide a barrier to hinder or prevent inadvertent actuation of the actuator 402. The main body 401 of the switch device 400 can have a single piece or unitary molded construction with the wall 404, or the wall 404 can be attached thereto after formation of the body. As illustrated, the base 401 may also include a raised portion 405 that extends upwardly from a lower base platform 403 by an inclined wall 409. The wall 404 may be disposed on the raised portion 405 of the switch body 401. Alternatively, the wall 404 may also extend upwardly from the lower platform 403 without including the raised portion 405. Electrical contacts 407 extend from the switch 400 and are configured to electrically couple with other lighted hat components, such as the power source 44, the various light sources/LEDs 50, 54, and/or other electrical components. By one approach, the main body portion 401 may include a lower module portion 410 that extends below the lower platform 403, from which the electrical contacts 407 extend. The contacts 407 may extend along a lower surface of the platform 403 and/or be received in channels or cutouts therein as best shown in FIG. 10. The lower module portion 410 may include the various electrical and other components of the switch device 400.

As shown in FIG. 10, the guard wall 404 may be an upstanding annular flange that encircles the plunger portion 416 of the switch actuator 402, but at the same time provides a switch opening 414 over the plunger 416 thereby providing direct access for intentional actuation of the switch actuator 402. The guard wall 404 may also only partially encircle the actuator 402 or the plunger 416 thereof, include a plurality of spaced wall segments adjacent to or around the actuator 402, or include wall segments on opposite sides of the actuator 402 (such as two wall segments on opposite sides of the actuator). While the guard wall 404 is shown having a circular shape about the actuator 402, the wall 404 may also have other shapes and sizes relative to the actuator 402 so long as it functions to prevent inadvertent actuation thereof.

The guard wall 404 provides a barrier or hard stop for the inadvertent actuation of the switch actuator 402 by maintaining a gap between the plunger 416 (or an actuation point 406 of the plunger) and a distal end 408 of the guard wall 404. By one approach as illustrated in FIG. 11, the guard wall 404 extends beyond a top end 418 of the plunger 416 so that the upper edge 408 of the guard wall 404 extends further from the lower platform 403 than the top end 418 of the plunger 416. Thus, to actuate the switch device 400, a user's finger needs to be inserted through the switch opening 414 formed by the wall 404 and inwardly past the wall upper edge 408 to engage the top end 418 of the plunger 416, which can then be depressed toward the main body platform 403. As discussed in more detail below, surfaces or objects larger than the switch opening 414 will generally not be able to extend therethrough to engage the plunger 416 or other portions of the actuator 402.

In another approach as illustrated in FIG. 12, the top end 418 of the plunger 416 may extend slightly beyond the upper edge 408 of the wall 404, but the actuation point 406 of the switch device 400 (that is, the point that the switch device is triggered between its on and off conditions, for example) is recessed below the upper edge 408 of the guard wall 404. Thus, while the top end 418 of the plunger 416 can protrude beyond the upper edge 408 of the guard wall 404, the switch device 400 in this approach will not be actuated until the plunger 416 is purposely pushed through the switch opening 414 and past the wall upper edge 408 to reach the actuation point 406 below the wall upper edge 408. In some cases, an audible click or other audible indication will signal that the plunger 416 has reached the actuation point 406. In other words, the switch 400 and plunger actuator 402 thereof have some play, where the plunger 416 may be depressed slightly without activating the switch device 400 between its on and off conditions. As the actuation point 406 is below the upper edge 408 of the guard wall 404, a user's finger must depress the actuator 402 past the upper edge 408 of the guard wall 404 a small distance in order to activate the switch. This approach is advantageous because with the actuator top end 418 protruding slightly beyond the wall upper edge 408, the exposed upper end 418 of the plunger 416 provides a tactile reference for a user to find the actuator portion 402.

Accordingly, if the switch device 400 is pressed against an adjacent surface (such as a shelf or multiple hats stacked together), the actuator 402 of FIG. 12 will depress slightly, such as to a position generally even with the upper edge 408 of the guard wall 404, but the guard wall 404 will prevent further actuation beyond the wall's upper edge 408 towards the actuation point 406. With the version of FIG. 11, an adjacent surface will not even be able to inadvertently engage the plunger actuator 402. Thus, the wall 404 substantially minimizes inadvertent actuation of the switch.

When mounted to the lighted hat 10, 11 (for example as the previously described switches 42, 43) the switch 400 enables a power source or other battery to be installed in the lighted hat 10 during manufacture so that the hat 10 can be shipped, stored, and displayed without the risk of the installed power source being drained by inadvertent actuation of the switch 400 due to an adjacent hat, a nested hat, a store self, or the like accidentally engaging and actuating the switch. The switch opening 414 of the guard wall 404 is sized so that direct actuation of the switch 400 can still be easily achieved with a finger or the like when the actuator 402 is depressed below the top edge 408 of the covering wall 404. While the switch 400 is described with respect to the lighted hat 10, the switch 400 could be utilized to prevent inadvertent actuation of any of the secondary electronically operable devices 27, such as cameras, speakers, radios, MP3 players, or the like.

With the switch 400 having the guard wall 404, the shield 110 discussed above with regard to the brim sleeve 102, 300 becomes unnecessary from an inadvertent actuation perspective. Accordingly, the lighted hat 10 with the switch 400 as the temporary switch 43 and a maintained switch 42 can have the brim sleeve associated therewith to be mounted thereto with only the switch cover 104 configured to prevent access to the maintained switch 42. The shield 110, however, draws a consumer's attention and can form a part of the "try-me" feature. Thus, the lighted hat 10, 11 can include the switch 400 and have a brim sleeve mounted thereto with the cover 104 and the shield 110.

Turning now to FIG. 13, a plurality of brims 16 of lighted hats 10, 11 are shown in a stacked configuration. As shown, the temporary switch 43 and the maintained switch 42 are positioned closely adjacent to one another, but the switches 42, 43 could be positioned apart from one another on other portions of the lighted hat 10, 11 as discussed above. Additionally, in the illustrated form, the temporary switch 43 is the switch 400 with the guard 404 discussed above. Each brim 16 has a brim sleeve 102, 300 mounted thereto. As such, the switches 42, 43 are shown mounted to the shape-retentive brim insert 24 on the brim lower surface 28 thereof. The switches 42, 43 may be secured to the insert 24 by screws, pins, adhesive, glue, Velcro, tape, and/or other suitable fasteners as needed for a particular application. Additionally, the brim insert 24 may also include a depression, cut-out, or pocket (not shown) sized to receive the lower module portion 410 so that lower switch device platform 403 can be received relatively flush against the brim insert 24 to minimize the profile thereof. The brim lower covering 36 includes the switch indicator portions 62, 64 to help aid the user in locating the switches. By one approach, the switch indicator portions 62, 64 may take the forms described above or may be an embroidered patch, a thickened fabric portion, multiple layers of fabric, other tactile references (bumps, ridges, or the like), and/or other suitable referencing features.

By one approach, the switches 42, 43 are preferably covered by the lower covering material 36 (such as a fabric layer) that extends across the lower major surface 28 of the brim 16. This configuration enables the switches 42, 43 to be substantially concealed from view, but the switch 400 still provides the integral switch guard discussed above. Alternatively, the lower covering material 36 may include an aperture or other opening (not shown) through which the guard wall 404 and actuator 402 extend through to be exposed on the lower surface of the brim. So configured, external switch guarding devices, packaging protective portions covering the switch, battery interrupts, and/or the like are generally not needed on headgear using the switch device 400 because the integral guard wall 404 thereof provides a built-in switch protector as described above.

Each of the stacked lighted hats 10, 11 has a brim sleeve 102, 300 mounted thereto. For each hat 10, 11, the brim sleeve body 103 mounts to the hat brim 16 to extend thereabout. The body 103 includes the shield 110 and cover 104 mounted thereto, where the shield 110 extends around its adjacent temporary switch 43 and the cover 104 extends around and over the maintained switch 42.

As shown in FIG. 13, the combination of the cover 104 and the switch wall 404 and/or the shield 110 is advantageous because they combine to prevent access to the maintained switch 42 and minimize unintentional actuation of the temporary switch 43, but still allow direct intentional actuation thereof. Pursuant to these goals, they keep adjacent surfaces away from the switches 42, 43. The illustrated application is simply one illustrative example of these functions. As shown, the hats 10, 11 are stacked together in a nested configuration for packaging and shipping to a store. In this example, the nested configuration includes a lower one of the lighted hats 10, 11 is nested with an upper one of the lighted hats 10, 11 such that the crown 14 of the lower lighted hat 10, 11 is inserted into the crown 14 of the upper light hat 10, 11 and the brim 16 of the lower lighted hat 10, 11 overlaps at least a portion of the brim 16 of the upper lighted hat 10, 11 (i.e., the lower brim 16 overlays the upper brim 16, which in turn overlays a further stacked brim 16). Each of the plurality of nested lighted hats 10, 11 has a spacer device in the form of the brim sleeve 102 mounted thereto to prevent inadvertent actuation of the temporary switch 43 on each of the hat brims 16 and prevent actuation of the maintained switch 42 on each of the hat brims 16.

To provide guarding, the shield member wall 152 has a height H1 thereof that is greater than a distance the switch 43 extends beyond a surface of the brim 16 so that the shield outwardly facing surface 164 is spaced a distance H2 from the switch 43. In this manner, the shield 110 and in particular the wall 158 thereof keeps the brim 16 of the adjacent, lower nested hat 10 spaced from the switch 43 of the hat brim 16 because the lower nested hat brim 16 abuts the shield outwardly facing surface 164. The height H1 of the guard wall 158 is also sufficiently high so that even if the lower covering 36 covering the brim 16 is pulled tight over the switch 43, the switch is still spaced from the shield outwardly facing surface 164.

To provide blocking, the switch cover 104 has a height H3 thereof that is greater than a distance the switch 42 extends beyond a surface of the brim 16 so that the cover wall 152 is spaced from the switch 42 to provide the headspace 154 therebetween. In this manner, the cover 104 keeps the brim 16 of the adjacent, lower nested hat 10 spaced from the switch 42 of the hat brim 16 because the lower nested hat brim 16 abuts the cover wall 152.

Lighted hats may be displayed on a store shelf prior to purchasing by a consumer. Many times, a consumer may wish to test a lighted hat to evaluate how well the illumination source on the hat works. While on display, the switch access opening 144 associated with the shield member 110 provides a user with intentional and direct access to the activation switch 106. A user may therefore use a finger to directly enter the switch access opening 144 and intentionally activate the switch 106 so that the illumination or other accessory devices can be tested while the hat is displayed on the store shelf. As described above, this configuration still prevents against unintentional actuation of the activation switch while allowing a user direct access to intentionally actuate the switch. In this manner, the hat 10 can be shipped to the store with the power source 44 already installed without the concern that the activation switch be inadvertently turned on during shipment which can drain the power source thereof.

In addition, while the shielding member/portion 110 of the guarding device 102 is preferably intended to avoid unintended activation of the illumination sources 116, the shielding member 110 may also be used to prevent inadvertent actuation of other switches configured to operate additional accessories mounted to headgear, such as cameras, speakers, radios, MP3 players to suggest a few examples. The cover 104 can be similarly used to prevent actuation of the other switches as desired.

It will be understood that various changes in the details, materials, and arrangements of the parts and components that have been described and illustrated in order to explain the nature of the lighted headgear may be made by those skilled in the art within the principle and scope as described herein.

The invention claimed is:

1. Lighted headgear comprising:

a head reception portion;

a brim portion extending outwardly from a forward, lower edge of the head reception portion;

a power source mounted to at least one of the head reception portion and the brim portion;

at least one light source mounted to the brim portion and electrically connected to the power source;

a maintained switch device mounted to the head reception portion or the brim portion configured to allow a user to shift the maintained switch device for selecting either on or off states of the light source with the light source staying in the selected state after the shifted maintained switch device is released; and a temporary switch device mounted to the head reception portion or the brim portion configured to allow a user to shift the temporary switch device for temporarily selecting the on state of the light source with the light source returning to the off state due to release of the temporary switch device.

2. The lighted headgear of claim 1 wherein the maintained switch device and the temporary switch device share a common electrical circuit for providing the electrical connection with the power source and the light source, with the common electrical circuit being configured such that with the maintained switch device shifted for selecting the light source on state, shifting and releasing of the temporary switch device will not cause the light source to return to the off state.

3. The lighted headgear of claim 1 wherein the head reception and brim portions have covering material thereon including switch cover portions extending over each of the switch devices with the switch cover portions having different configurations from each other so that the switch cover portions are tactilely distinct from each other to provide the user a tactile indication as to which switch device is being operated.

4. The lighted headgear of claim 3 wherein at least one of the switch cover portions is an embroidered fabric cover portion.

5. The lighted headgear of claim 3 wherein both of the switch cover portions are embroidered fabric cover portions each having different embroidered configurations from each other.

6. The lighted headgear of claim 1 wherein the maintained switch device and the temporary switch device are both mounted to the brim portion.

7. The lighted headgear of claim 6 wherein the maintained switch device is adjacent one side edge portion of the brim portion and the temporary switch device is adjacent the opposite side edge portion of the brim portion.

8. The lighted headgear of claim 6 wherein the maintained switch device and the temporary switch device are adjacent a side edge portion of the brim portion.

9. The lighted headgear of claim 1 wherein the maintained switch device and the temporary switch device have a single outer housing for both switch devices.

10. The lighted headgear of claim 1 wherein the temporary switch device has a switch actuator for being shifted by the user, and a switch guard device associated with the temporary switch device configured to be disposed at least partially about the temporary switch device actuator to minimize unintentional shifting thereof and has an access opening to allow intentional and direct access to the temporary switch device actuator for shifting thereof.

11. The lighted headgear of claim 10 wherein the temporary switch device actuator includes a plunger that has a depressed activation position at which the light source is in the on state, and the switch guard device includes an annular wall integral with the temporary switch device and sized to extend beyond the depressed activation position of the plunger.

12. The lighted headgear of claim 10 wherein the switch guard device comprises an annular member that is a portion of removable brim packaging sized to fit on the brim portion.

13. The lighted headgear of claim 1 further comprising a removable switch cover removably mounted to the headgear to deny access to the maintained switch device until the removable switch cover is removed.

14. The lighted headgear of claim 1 wherein the at least one light source comprises multiple light sources, the temporary switch device is configured to allow a user to shift the temporary switch device for temporarily selecting the on state of the multiple light sources, and the maintained switch device is configured to allow a user to shift the maintained switch device for selecting one of multiple on states having differing combinations of energized light sources of the multiple light sources or the off state.

15. Lighted headgear comprising:

a head reception portion;

a brim portion extending outwardly from a forward, lower edge of the head reception portion;

a power source mounted to at least one of the head reception portion and the brim portion;

multiple electrically operable devices mounted to at least one of the head reception portion and brim portion and electrically connected to the power source to be powered thereby;

a first actuator device mounted to at least one of the head reception portion and the brim portion and operably coupled to the power source and the at least one electrically operable device, the first actuator device configured to allow a user to operate at least one of the multiple electrically operable devices;

a guard device associated with the first actuator device configured to be disposed at least partially about the first actuator device to minimize unintentional actuation thereof and having an access opening to allow intentional direct access to the first actuator device for actuation thereof;

a second actuator device mounted to at least one of the head reception portion and the brim portion and operably coupled to the power source and the at least one electrically operable device, the second actuator device configured to allow a user to operate either the at least one electrically operable device operated by the first actuator device or another one or more of the multiple electrically operable devices;

a cover member removably mounted to the headgear to deny access to the second actuator device until the cover member is removed.

16. The lighted headgear of claim 15 wherein the multiple electrically operable devices comprise multiple light sources.

17. The lighted headgear of claim 16 wherein the first actuator device is an on/off switch device configured for selectively energizing the multiple light sources and the second actuator device is a temporary switch device configured for temporarily selectively energizing the multiple light sources.

18. The lighted headgear of claim 15 wherein the multiple electrically operable devices comprise one or more light sources and a camera device.

19. The lighted headgear of claim 18 wherein the first actuator device is configured for selectively operating the camera device and the second actuator device is a light switch device configured for selectively energizing the one or more light sources.

20. The lighted headgear of claim 15 wherein the guard device is a generally annular wall integral with the first switch device.

21. The lighted headgear of claim 15 wherein the first and second switch devices are mounted to the brim portion, and the guard device and the cover member are portions of removable brim packaging sized to fit on the brim portion.

22. The lighted headgear of claim 21 wherein the guard device and the cover member have a single-piece plastic construction.

23. The lighted headgear of claim 21 wherein the first switch device is adjacent one side edge portion of the brim portion and the second switch device is adjacent the opposite side edge portion of the brim portion.

24. The lighted headgear of claim 21 wherein the first switch device and the second switch device are adjacent a side edge portion of the brim portion.

25. The lighted headgear of claim 15 wherein the head reception and brim portions have covering material thereon including switch cover portions extending over each of the first and second switch devices with the switch cover portions having different configurations from each other so that the switch cover portions are tactilely distinct from each other to provide the user a tactile indication as to which switch device is being operated.

26. The lighted headgear of claim 15 wherein the first switch device is a maintained switch device mounted to the head reception portion or the brim portion configured to allow a user to shift the maintained switch device for selecting either on or off states of the one or more light sources with the one or more light sources staying in the selected state after the shifted maintained switch device is released, and the second switch device is a temporary switch device mounted to the head reception portion or the brim portion configured to allow a user to shift the temporary switch device for temporarily selecting the on state of the light source with the light source returning to the off state due to release of the temporary switch device.

27. The lighted headgear of claim 26 wherein the at least one light source comprises multiple light sources, the temporary switch device is configured to allow a user to shift the temporary switch device for temporarily selecting the on state of the multiple light sources, and the maintained switch device is configured to allow a user to shift the maintained switch device for selecting one of multiple on states having differing combinations of energized light sources of the multiple light sources or the off state.

28. A brim sleeve for being removably mounting to a brim portion of lighted headgear having first and second light switch devices mounted to the brim portion, the brim sleeve comprising:

a thin body of generally flexible material;

an upper portion of the thin body being sized for extending across the brim portion;

at least one lower portion of the thin body that is oriented for extending adjacent to at least the first light switch device;

a switch cover of the body lower portion configured for extending around and over the first light switch device to substantially prevent actuation thereof by denying access to the first light switch device; and wherein the at least one lower portion is configured to allow access to the second light switch device.

29. The brim sleeve of claim 28 further including a switch guard device mounted to the body lower portion configured to be disposed at least partially about the second light switch device to minimize unintentional actuation thereof and having an access opening to allow intentional and direct access to the second light switch device for actuation thereof.

30. The brim sleeve of 29 wherein the switch cover and the switch guard device have a single piece construction for both the switch cover and the switch guard device.

31. The brim sleeve of claim 29 wherein the at least one lower portion of the thin body includes at least partially overlapping flaps, the switch cover is mounted to one of the flaps, and the switch guard device is mounted to the other of the flaps.

32. The brim sleeve of claim 29 wherein the switch guard device includes an upstanding generally annular wall extending away from the brim portion to provide a spacer for surfaces adjacent to the brim portion to minimize unintentional actuation of the second light switch device.

33. The brim sleeve of claim 32 wherein the switch guard device further includes an annular flat base flange extending from a lower edge of the upstanding wall portion for seating the switch guard device on the brim portion.

34. The brim sleeve of claim 33 wherein the upstanding generally annular wall of the switch guard device includes an inner upstanding flange and an outer upstanding flange tapered generally toward each other for providing rigidity to the upstanding generally annular wall.

35. The brim sleeve of claim 29 in combination with the second light switch device wherein the second light switch device has an integrated switch guard configured to at least partially extend around a plunger of the second light switch device to minimize unintentional actuation thereof.

36. The brim sleeve of claim 28 wherein the switch cover is a rigid molded plastic member secured to the lower portion of the thin body.

37. The brim sleeve of claim 28 wherein the switch cover includes a lower edge portion for seating on the brim portion and extending generally around the first light switch device, and at least one wall extending from the lower edge portion generally transverse to the brim portion to form a substantially unbroken surface for denying access to the first light switch device.

38. The brim sleeve of claim 32 wherein the substantially unbroken switch surface comprises a dome-shaped surface.

39. Lighted headgear comprising:

a head reception portion;

a brim portion extending outwardly from a forward, lower edge of the head reception portion;

a power source mounted to at least one of the head reception portion and the brim portion;

one or more light sources mounted to the brim portion and electrically connected to the power source to be powered thereby;

a temporary switch device mounted to the head reception portion or the brim portion configured to allow a user to shift the temporary switch device for temporarily energizing the one or more light sources with the one or more light sources de-energizing upon release of the temporary switch device;

a switch guard device associated with the temporary switch device configured to be disposed at least partially about the temporary switch device to minimize unintentional shifting thereof and having an access opening to allow access to the temporary switch device for intentional actuation thereof.

40. The lighted headgear of claim 39 wherein the temporary switch device includes a plunger having a depressed activation position at which the temporary switch device energizes the one or more light sources, wherein the switch guard device includes an upstanding wall configured to extend away from the brim portion a distance further than the depressed activation position of the temporary switch device plunger.

41. The lighted headgear of claim 40 wherein the switch guard device is a generally annular wall integral with the temporary switch device.

42. The lighted headgear of claim 39 further comprising a maintained switch device mounted to the head reception portion or the brim portion configured to allow a user to shift the maintained switch device for selecting either on or off states of the one or more light sources with the one or more light sources staying in the selected state after the shifted maintained switch device is released.

* * * * *